US008789520B2

(12) United States Patent
Nebergall

(10) Patent No.: US 8,789,520 B2
(45) Date of Patent: Jul. 29, 2014

(54) COMPOUND ARCHERY BOW AND FIRING SYSTEM FOR THE SAME

(71) Applicant: Dirk Nebergall, Sanford, FL (US)

(72) Inventor: Dirk Nebergall, Sanford, FL (US)

( * ) Notice: Subject to any disclaimer, the term of this patent is extended or adjusted under 35 U.S.C. 154(b) by 0 days.

(21) Appl. No.: 14/017,906

(22) Filed: Sep. 4, 2013

(65) Prior Publication Data

US 2014/0069400 A1 Mar. 13, 2014

Related U.S. Application Data

(63) Continuation-in-part of application No. 13/407,254, filed on Feb. 28, 2012, which is a continuation-in-part of application No. 13/407,254, filed on Mar. 1, 2011, now Pat. No. 8,522,763.

(51) Int. Cl.
*F41B 5/12* (2006.01)

(52) U.S. Cl.
USPC ..... 124/25.6

(58) Field of Classification Search
CPC ..... F41B 5/10; F41B 5/14; F41B 5/123; F41B 5/0094
USPC ..... 124/25.6, 900
See application file for complete search history.

(56) References Cited

U.S. PATENT DOCUMENTS

| | | | |
|---|---|---|---|
| 428,912 | A | 5/1890 | Holmes |
| 2,714,377 | A | 8/1955 | Mulkey |
| 4,458,657 | A | 7/1984 | Stockmar |
| 4,756,295 | A | 7/1988 | Guzzetta |
| 5,150,699 | A | 9/1992 | Boissevain |
| 5,205,269 | A | 4/1993 | Guzzetta |
| 5,373,831 | A | 12/1994 | Cushman |
| 5,535,727 | A | 7/1996 | Helmuth |
| 5,638,804 | A | 6/1997 | Remick et al. |
| 6,055,974 | A | 5/2000 | Dieziger |
| 6,698,413 | B1 | 3/2004 | Ecklund |
| 7,201,161 | B1 | 4/2007 | York |
| 2003/0084893 | A1 | 5/2003 | Andrews |

OTHER PUBLICATIONS

"Compound Bow Selection Guide"; www.huntersfriend.com/bowselction.htm; 2007 Hunter's Friend, LLC.

International Search Report and Written Opinion dated Jun. 8, 2012, in International Application No. PCT/US2012/026963, Filed Feb. 28, 2012.

*Primary Examiner* — Gene Kim
*Assistant Examiner* — Amir Klayman
(74) *Attorney, Agent, or Firm* — Rankin, Hill & Clark LLP

(57) ABSTRACT

A spring loaded crossbow and, more particularly, a crossbow having a firing system with a single spring assembly and a pair of cranks each having a first leg engageable against the single spring assembly and second legs to support rotatable archery cams.

25 Claims, 15 Drawing Sheets

COMPOUND ARCHERY BOW AND FIRING SYSTEM FOR THE SAME

This application is a Continuation-in-Part application of copending application Ser. No. 13/407,254 that was filed on Feb. 28, 2012 and which is incorporated by reference into this application and which is a Continuation-in-Part application of application Ser. No. 12/932,561 that was filed on Mar. 1, 2011, now U.S. Pat. No. 8,522,763, issued Sep. 3, 2013, and which is also incorporated by reference into this application.

The present invention relates to compound archery bows and especially to an improved a spring loaded compound archery bow.

BACKGROUND OF THE INVENTION

The traditional archery bow is comprised of a riser having a hand grip and an arrow rest and a pair of resilient limbs attached to each end of the riser. The resilient limbs of the bow flex to produce a stored energy needed to propel an archery arrow. The bow string is attached to the free end of each resilient limb so that when the bow string is drawn back from its initial position by an archer to shoot an arrow, the resilient limbs flex to place the bow string under tension. The further the archer draws the bow string back, the more the resilient limbs of the bow are flexed which imparts a greater amount of stored energy in the bow. When the bow string is released to shoot the arrow, the resilient limbs of the bow snap back to their original position to force the bow string back to its initial position to propel the arrow towards a target. These traditional bows are frequently made of strong composite materials but they do have drawbacks. For instance, once an archer selects a particular archery bow, he is restricted with that bow to a maximum drawing force so that the archer is unable to vary the poundage range for a particular bow. Yet other drawbacks include the holding forces relating to these types of bows; especially when in the full drawn position. In this respect, the stored energy of a traditional bow increases as the bow string is drawn back. Similarly, the holding forces increase as the bow string is drawn back such that the maximum stored energy is generally coupled with the maximum hold force when the bow is in the full drawn position. In that this is the firing position for the bow, the shooter exerts considerable energy in holding the bow in the full drawn position to take aim at the desired target. When using a bow for hunting, this can be very difficult and can cause shots to be rushed and/or off target. Further, this condition limits the amount of stored energy that can be utilized in a traditional bow in that high levels of stored energy produce high holding forces that cannot be overcome by the shooter. Therefore, the traditional bow has limits to its ability to utilize and manage high levels of stored energy. Yet even further, not only is it difficult or impossible to modify the traditional long bow, special equipment is needed to remove the bow string from the bow limbs in that they must be pre-stressed in order to produce the necessary stored energy. While, in some cases, the bow string could be removable, it is difficult and requires a lot of strength.

While traditional bows utilize the limbs to produce stored energy, some prior art bows have attempted to use springs for loading the bow that have not had any real success. An earlier spring loaded archery bow can be seen in the D. M. Holmes U.S. Pat. No. 428,912 which includes a tension spring extending through the riser of the bow. As can be seen, this drastically limits the configuration of the riser which has been found to be an integral part of a bow design. As with many hand operated tools, ergonomics are very important and this spring design adversely affects the riser's ergonomics significantly. Yet even further, the use of a tension spring also greatly increases the objectionable sound that is produced by the system. As can be appreciated, when this spring snaps back to its at rest position, it will wobble and produce noise that is not acceptable when hunting. Yet even further, this spring wobble could likely be felt in riser by the archer which is also not acceptable and which could affect accuracy. Further, the Holmes bow cannot be modified and the stored energy and hold force will be at its highest level at the full draw point just like a traditional bow. Thus, while this bow may be capable of producing higher amounts of stored energy, it is very similar to a traditional bow and does not allow for the management of those higher energy levels. This design is also not adjustable and requires a custom spring that has opposing extensions for connecting the spring to the limbs.

Similarly, U.S. Pat. No. 4,458,657 to Stockmar discloses an archery bow that does not utilized flexible limbs, Stockmar discloses a complicated bow structure with both a main frame and a separate handle grip space forwardly of the frame wherein the bow string tensioning assembly is located forward of the main frame. The bow string tensioning assembly is formed by exposed resilient tubes for tensioning the bow string which are stretched and placed in tension when the bow string of the bow is drawn. By including both a riser and a solid frame, this design drastically increases the weight of the bow. As can be seen, Stockmar recognized this problem by include weight reducing holes in his frame design. Yet further, this design has exposed workings that could be dangerous and which would be drastically impacted by weather changes. As is now, resilient materials, such as those disclosed, will produce greatly different amounts of stored energy in cold weather than in warm weather. Further, by including significant frame and riser designs, this system will create significant blind spots which is especially problematic when quick target acquisition is needed; such as when the bow is used for hunting. The frame design behind the handle grip or riser also creates a design flaw wherein the archer's arm would likely engage this frame structure when firing the bow.

A compound archery bow uses mechanical advantage to overcome many of the shortcomings of the traditional bow and the spring loaded bows that simulate traditional bows to allow for increases in stored energy while managing the holding forces when in the full drawn position. This is typically accomplished by utilizing cams and/or pulleys attached to the limbs of the bow. Again, the limbs act to store energy and can be designed to store greater amounts of energy wherein the limbs of a compound bow are usually much different than those of a traditional archery bow. Further, the cams of a compound bow can be utilized to both increase the stored energy and reduce the hold force when the bow is in the full drawn position which allows the compound bow to direct much greater amounts of energy into the arrow. In that the compound bow attaches the bow string to cams or pulleys to give a mechanical advantage to the bow string, when the bow string is pulled, it causes the cams to rotate and the limbs to bend. Again, the limbs provide the stored energy, but the cams provide mechanical advantage to increase the stored energy and to decrease the hold force in the full drawn position. However, while the hold force may be lower for the full drawn position, it is typically higher before the full drawn position is reached. A compound bow has a rigid handgrip or riser having limbs attached to each end and having the sights and the like attached thereto.

Even though compound bows have overcome many shortcomings in the traditional bow, it also has many limitations; one such limitation is that it is not easily adjustable. As with the traditional bow, the compound bow relies on the stored energy of the flexible limbs which cannot be changed. These flexible limbs are built into the compound bow and cannot be adjusted or modified once the bow is manufactured. However, it has been found that the cams can be utilized to change the dynamics of the compound bow wherein the overall stored energy of the system can be modified by changing the cam configuration. Further, other dynamics can be modified by changing the cams of the bow. However, while the use of rotating cams allows for modifications, these cannot be done easily and typically require expensive equipment that must be used to overcome the high levels of stored energy in the flexible limbs. In this respect, an archer who wants to modify their bow must take their bow to an archery dealer who has the equipment to compress the limbs of the bow sufficiently to loosen the bow string and remove the cam or cams without damaging the flexible limbs that can be very fragile. The same is true for repairs to damaged bows. These cannot be done without specialized equipment. Thus, if a bow is damaged in the field (such as while on a hunting trip), the hunter cannot fix his damaged bow and typically caries a spare bow just for this situation. Even if the hunter did own the necessary equipment, it is not practical to take the needed equipment into the field. Thus, while the compound bows allow for the use and management of higher levels of stored energy, that is essentially the extent of the benefit of these bows. In addition, it has been found that the flexible limbs used in compound bows can fail over time and this is being made worse by the ever increasing amounts of pre-load tension that is being put into these flexible limbs when the bows are strung. This is especially true with crossbows wherein crossbow limbs are being preloaded with such high tension for arrow speed that the limbs often break.

In the York U.S. Pat. No. 7,201,161, disclosed is another spring loaded archery bow that also incorporates a spring in the riser portion of the bow. York discloses a riser that has separate upper and lower spring tensioning assemblies and these assemblies both include a central tension cable that extends within a coil spring to join opposing swoosh shaped cam members. As with the spring mechanism discussed above, this central cable structure is positioned closely to the coil spring and would likely be noisy in operation. Further, separate upper and lower spring tensioning assemblies are contained within the upper and lower rigid limbs of the bow so that the bow retains the appearance of a traditional archery bow. In the Dieziger U.S. Pat. No. 6,055,974 a compound bow has a facilitated draw for allowing a bow string to be more easily drawn and uses a pair of complicated and fragile coil springs string structures that are fully exposed. Further, as with other spring bow systems, while springs are disclosed, these systems do not include structure that van be easily modified for the many archers that may use a single bow. In the L. J. Mulkey U.S. Pat. No. 2,714,377, discloses a complicated spring structure system that surrounds the riser of the bow and which is fully exposed even though it is in close proximity to the archers hands and arms. Similarly, the Guzzetta U.S. Pat. No. 4,756,295 discloses a complicated bow structure that includes linkages extending about the riser of the bow and which are again fully exposed. While the toggle-like assembly may be configured to improve the accuracy and acceleration of the bow, it utilizes a single coil spring and requires many components that would add weight and complexity to the system.

Eklund U.S. Pat. No. 6,698,413 discloses an archery bow includes a solid and rigid frame having no flexing or pivoting components. Conversely, Eklund discloses a bow that uses a rotating wheel to create the necessary stored energy to shoot an arrow. This system includes a lower wheel rotatably mounted to the lower limb that rotatably attached to a self-contained tensioning unit having a variably compressible power coil spring therein. A cam is rotatably mounted to the lower limb between the lower wheel and the tensioning unit and is engaged by a cable which connects the spring with the lower wheel so as to provide a resilient pull to establish a draw weight required to move the bowstring from an at-rest position to a drawn position. While Eklund disclose adjustment to the pull length, this bow system is also not easily modifiable and is significantly out of balance. As can be seen, the vast majority of the bow weight is located on one side of his bow which greatly reduces the ability to aim this bow.

Again, while there are many bow designs, there remains a need for an effective archery bow that is lightweight, reliable, and fully adjustable without needing to take the bow to an archery shop. Further, this bow needs to be capable of producing high shooting speeds, but with low holding forces at full draw. While many of the bows discussed above have some of these features, none have all and many are deficient in many ways. Thus, many of these designs have never been produced.

All of the above-mentioned patents are incorporated by reference herein as background material. Also incorporated by reference is the printout from Hunter's Friend which is printed from huntersfriend.com.

SUMMARY OF THE INVENTION

The invention of this application relates to archery bows that have these characteristics and, more particularly, to a compound—bow that includes a quiet spring system that is simple, compact rugged, adjustable, modifiable, and produces a high level of stored energy and low hold force in the full drawn position.

More particularly, the bow of this application includes a firing system having a spring assembly, a generally L-shaped crank and a rotatable cam. The spring assembly having a spring housing with a rearwardly facing opening and an inner passage extending inwardly from the rearward opening. The spring assembly further including a compression spring extending in the inner passage and having a spring end cap at a first end facing the rearward opening. The L-shaped crank having a first leg and a second leg extending from a common pivot portion and the crank being rotatable about a crank axis in the pivot portion and the crank axis being generally fixed relative to a central frame structure of the bow, the first leg having an engaging surface spaced from the central axis configured to engage the end cap of the compression spring when the crank is rotated about the crank axis, but which is not connected thereto. The second leg having a pivot joint spaced from the crank axis configured to support the rotatable cam thereby allowing the cam to rotate about a cam axis spaced from the central axis. The cam having an outwardly facing cam shaped guide groove configured to support and guide a bow string about the rotatable cam as it is rotated about the cam axis. The firing system providing stored energy to shoot an associated archery arrow in that when the bow string is pulled back for shooting the associated arrow, both the cam rotates about the cam axis and the crank rotates about the crank axis wherein the crank compresses the compression spring to provide an amount of stored energy to propel the associate arrow and the cam provides at least one of increasing the amount of stored energy and reducing a holding force for the shooter when the bow is at full draw. In addition, it has been found that this bow system is not only more effective that prior art designs, but it is even quieter that traditional compound bows that do not utilize springs in that the flexible limbs even create noise when that snap back to their at rest position.

According to other aspects of the invention of this application, the spring assembly is adjustable wherein the amount of stored energy can be adjusted.

According even yet other aspects of the invention of this application, the spring is adjustable to a degree that allows a substantial portion of the spring force to be reduced such that work to be bow can be performed without expensive equipment. This can include, but is not limited to, fixing bow strings, replacing bow strings, changing springs, changing cams and/or rollers and/or adjusting the ergonomics of the bow.

According yet other aspects of the invention of this application, the spring assembly can be configured to engage, but not be connected to the crank wherein the spring assembly, crank, and any other portion of the bow system can be removed and/or adjusted without complicated disassembly of any one component.

According to even yet further aspects of the invention, the spring assembly can be telescopically received in a spring housing support such that the ergonomics of the entire bow can be changed including, but not limited to, changing the spacing between a bow riser and the bow string. As can be appreciated, this can be utilized to allow the bow to be used for both adults and kids; and can be used to fine tune the bow string spacing based on personal preferences.

According to another aspect of the invention of this application, the bow riser can include replaceable grips such that the grip portion of the riser can be modified based on the archer's hand size and/or personal preferences. This can also allow for the use of specialized materials such as, but not limited to, soft touch materials, rubbers, polymers and the like. Yet even further, it can allow for the modification of the location of the hand grip; thus maximizing the ergonomic ability of the bow.

According to yet another aspect of the present invention, the ability to remove the spring force from the system and the separate spring assembly configuration allows the spring assembly to be easily removed from the riser whereby one set of spring assemblies could be used on multiple risers and/or bow frames; such as a crossbow frame.

According to further aspects of the invention, the firing system of this application can be utilized for both a vertical bow and a crossbow. And, for both bow designs, the invention of this application eliminates the flexible limbs that can break over time.

According to yet further aspects of the invention, the firing system can be sold in kit form including components to modify the archery bow. This can include, but is not limited to, at least one set firing systems, a riser, a crossbow frame, multiple hand grips, one or more cams of different configurations, idler wheels, bow strings, calibration strings and components, cranks and/or multiple sets of compression springs for the spring assemblies.

Yet even further, the use of the firing systems of this application allow for the bow to be much more compact in design than prior art bows and compound bows and better balanced. In this respect, in that prior art bows utilized the flexible limbs for the stored energy, they necessitate large flexible limbs to produce the necessary stored energy for high arrow speeds. The invention of this application greatly reduces this requirement for both long bows and crossbows. Further yet, in that the system can be joined to any riser configuration, the riser can be fully customizable and configured to any desired ergonomic design. With respect to balance, many of the prior art designs include complicated and heavy firing systems that are unbalanced either front to back and/or top to bottom. Further, the weight of these systems are space to the outer sides of the bow wherein these bow systems make hunting holding the bow more difficult, target acquisition slower and make the bow awkward to handle.

Yet further, in one set of embodiments, the firing system includes a single spring assembly that can be a central spring assembly wherein the bow includes opposing crank arms that both obtain their shooting energy from the single spring assembly. This configuration has been found to work particularly well in connection with crossbows by maintaining high arrow speeds in a compact design without the need of flexible limbs that can break.

In an additional set of embodiments, the firing system can include multiple spring loads, such as a "light" spring and a "heavy" spring. The multiple spring load configuration can be used for multiple use. For example, multiple spring loads can be utilized to increase the adjustability of the shooting load of the bow. Yet further, the multiple spring loads can be utilized to create both a pre-load to allow a crossbow to be easily cocked and a separate shooting load that is selectively engageable to provide the high energy to propel the arrow that can be applied after the crossbow is cocked.

Further, these and other objects, aspects, features, developments and advantages of the invention of this application will become apparent to those skilled in the art upon a reading of the Detailed Description of Embodiments set forth below taken together with the drawings which will be described in the next section.

BRIEF DESCRIPTION OF THE DRAWINGS

The invention may take physical form in certain parts and arrangement of parts, preferred embodiments of which will be described in detail and illustrated in the accompanying drawings which form a part hereof and wherein.

DETAILED DESCRIPTION OF EMBODIMENTS

Figure 1:
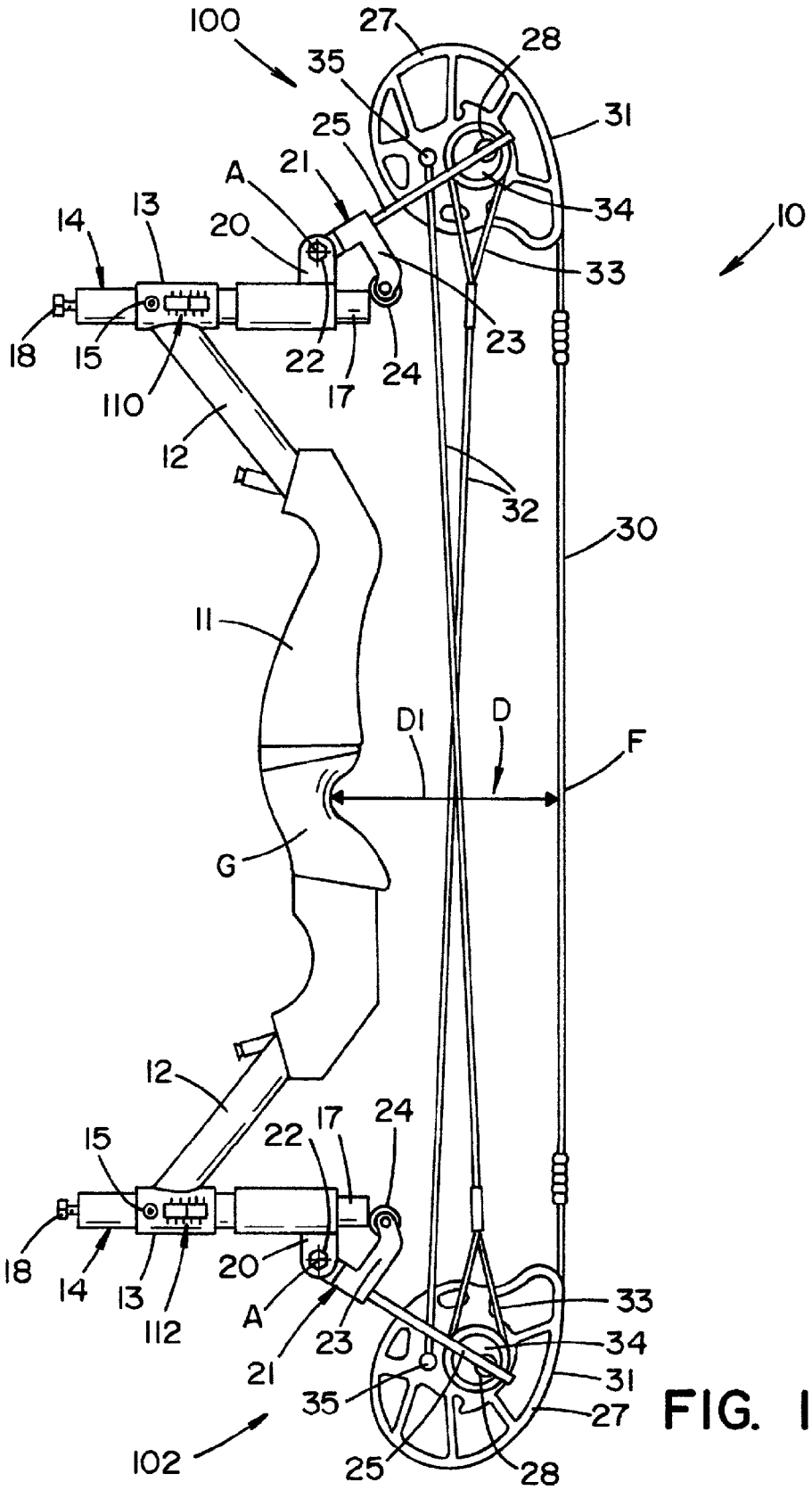
FIG. 1 is a side elevation of a compound bow in accordance with certain aspects of the present invention.
Figure 4:
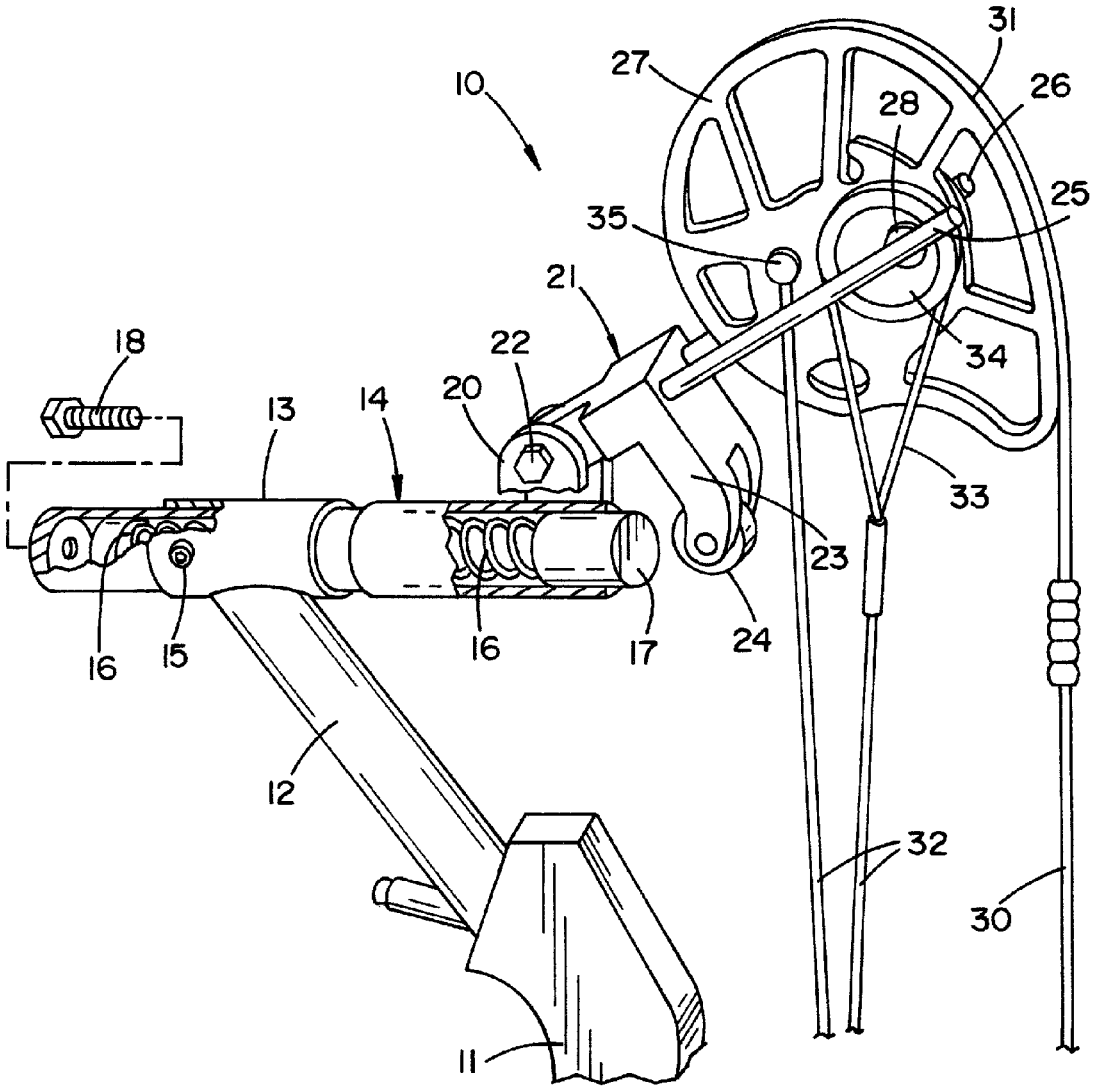
FIG. 4 is an enlarged partial cutaway perspective view of the firing system of the compound bow of FIGS. 1 through 3.

Referring now to the drawings wherein the showings are for the purpose of illustrating preferred and alternative embodiments of the invention only and not for the purpose of limiting the same, FIG. 1, shows a compound archery bow 10 that includes a riser 11 which is a central mount for the components of the bow and includes a handgrip G for gripping the bow. The riser 11 has a limb 12 at each end thereof rigidly attached thereto. Each limb can include a spring mount or cylinder 13 attached to the end thereof, which cylinder is shaped to receive a spring housing 14 slidably positioned therein. The slidable spring housing may be locked in position with a lock down threaded screw 15, as seen in FIG. 4. The spring housing 14 has a coil spring 16 mounted thereinside having an end cap 17 on one end thereof and also having a threaded bolt 18 at one end of spring housing 14 which can be threaded in or out to pre-compress coil springs 16. Each spring housing 14 can include a yoke 20 rigidly attached thereto which has a crank 21 rotatably attached within yoke 20 by an axle bolt 22. However, as will be discussed in greater detail below, this yoke or mount is merely joined relative to the spring assembly and can be joined to other components of the bow without detracting from the invention of this application. Crank 21 can be a generally L-shaped crank an arm 23 having a roller 24 mounted on the end thereof and aligned so that rotation of crank 21 in yoke 20 attached to spring housing 14 will drive arm 23 and roller 24 against spring cap 17 to compress coil spring 16. Each crank 21 has a pair of lever arms 25 and 26 attached thereto and extending therefrom and has a cam 27 attached thereto with a shaft 28 extending between arms 25 and 26 to rotatably hold cam 27 therein. A bow string 30 is attached to each cam and wraps around a camming surface 31 so that pulling on bow string 30 will rotate cams 27 as well as pull lever arms 25 and 26 and rotate crank 21. The rotation of crank 21, in tern rotates arm 23 about a crank axis A which urges roller 24 against coil spring cap 17 to compress spring 16 to produce at least part of the stored energy to shoot the archery arrow. In at least one embodiment, spring cap can further include a bearing member or portion 17A/17B that can engage the inner surface of the tube and space the end cap from the tube for reduced friction and noise. Further, this design allows the bearing member to be made from materials known in the art that have a low coefficient of friction and high wear characteristics while allowing cap 17 to be formed from materials designed to support the loaded engagement of roller 24. This material can include the use of any materials known in the art including, but not limited to, aluminum, aluminum alloys, steel, steel alloys and polymers. As can be appreciated, lubricants can also be used to reduce friction and/or noise. Further, this bearing member can be fixed relative to the tube (shown as 17A in FIG. 5A) or fixed relative to the cap (shown as 17B in FIG. 9) without detracting from the invention of this application.

The bow can further include a pair of timing cables 32 that extend between the pair of cams 27, each cable at one end having a loop 33 formed therein which attaches around a pulley 34 on each cam with the other end of each cable pinned with a pin 35 to the side of cam 27.

Figure 2:
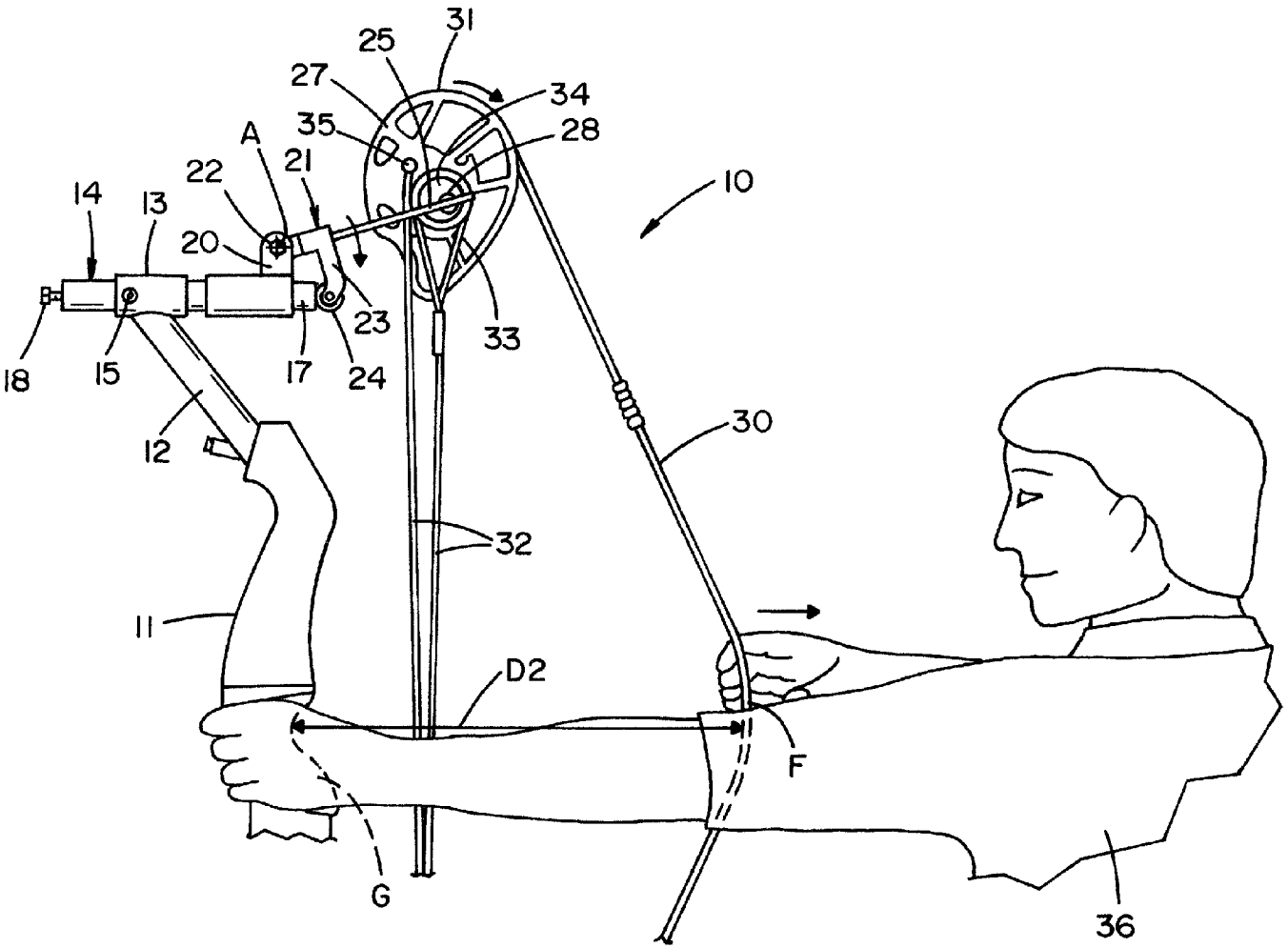
FIG. 2 is a side elevation view of an archer pulling the bow string of the bow of FIG. 1.
Figure 3:
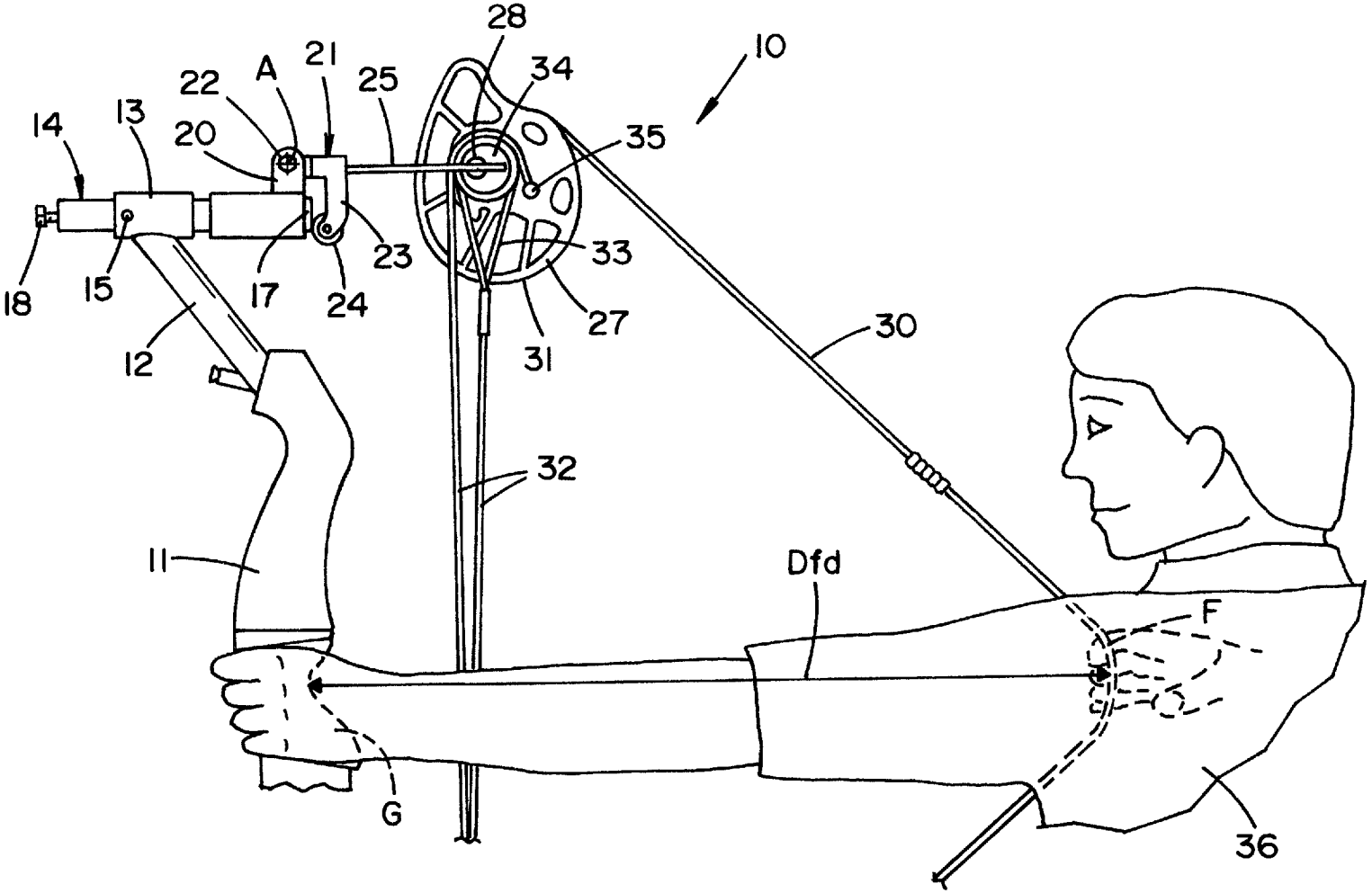
FIG. 3 is a side elevation in accordance with FIG. 2 in which the archer has pulled the bow string to the full drawn position.

In operation, an archer, as seen in FIGS. 2 and 3, pulls bow string 30 which begins to rotate cams 27 and which rotates arms 25 and 26 to rotate crank 21 which drives roller 24 against cap 17 to compress the spring in spring housing 14. Drawing bow string 30, as seen in FIG. 3, further rotates cam 27 to further compress each coil spring 16 for shooting an arrow from bow 10. Since each archer 36 has a different physical built, the present compound bow is easily adjustable by loosening each lock down screw 15 to slide each spring housing 14 in and out of its sleeve 13 on the end of each limb 12 to adjust the bow for a particular archer which will be discussed in greater detail below. In addition, coil spring 16 can be pre-adjusted by threading pre-adjustable screw 18 into or out of the end of spring housing 14 to adjust the compression of coil spring 16 to adjust the amount of pull required on a bow string 30 by a particular individual archer 36.

With respect to the adjustability of the bow 10, all bows have a bow spacing D between the hand grip G of the bow and the bow string 30 at a finger point F where the archer pulls back the bow string. As is shown, spacing D is a spacing D1 which represents an at rest spacing for the bow wherein the spacing is general at a minimum. Then, as is shown in FIGS. 2 and 3, D increases from D1 to D2 and Dfd when the bow is at full draw. As can be appreciated, these spacings or distances can changed based on the bow design and should change based on the size of the shooter too. However, prior art bows do not incorporate means to change this distance at all or at least easily wherein the archer typically had to purchase different bows for each size person and to settle for a "good enough" spacing even for his own personal bow. As can also be appreciated, it is expensive to purchase bows for each size person and for each use which will discussed more below. In according with the invention of this application, and which is not possible with the prior art in view of their complicated bow and firing designs, the bow string spacing can be easily adjusted to allow the bow to be used for multiple sized users or to just fine tune the bow configuration for a single user.

In this respect, according to certain embodiments of this application, bow 10 is provided, which is an adjustable bow that allows distance D to be readily adjusted to suit any needs or desires of the archer shooting the bow. In this respect, and as was discussed briefly above, spring housing 14 is adjustable relative to riser 11 such that firing systems 100 and 102 can be moved towards or away from grip G. As a result, bow string 30, which follows firing systems 100 and 102, can be adjusted toward or away from the grip of the bow. Then, once a desired grip spacing is achieved, the spring housing can be selectively locked relative to the bow frame. In the embodiment shown in FIG. 1, this can be the spring housing being locked relative to limb 12 on both the top and bottom side of the bow frame. However, bow 10 does not require the inclusion of limbs 12 wherein the spring assembly can be joined directly to the riser. Essentially, the firing systems of this application are fixed relative to the bow riser or bow frame and can be done so any way known in the art including connecting the assemblies directly to the riser or using limb structures as is shown to produce a desired height or width of the bow. Further, the limb configuration could be modified without departing from the invention of this application. As will be discussed in greater detail below relating to the use of the invention of this application on crossbows, this central bow frame can be any frame structure, but is preferably a generally rigid structure wherein firing systems 100 and 102 produce the necessary stored energy to propel an arrow and/or control the stored energy by the use of cam-shaped rotatable bow string supports and/or cam shaped spring engager which will be discussed more below.

Further, set screw 15 can be utilized to selectively fix the position or alignment of the firing systems relative to the bow frame. However, this application is not to be limited to a set screw wherein any locking arrangement could be utilized to fix the spring assemblies relative to the bow frame. This can include, but is not limited to, jam nuts threaded onto the spring assembly, a threaded engagement between the spring assembly and the frame portion supporting the spring assembly that can include a rotating collar to prevent the rotation of the firing systems, locking pins, spring-loaded pins and the like.

In yet other embodiments, bow 10 can include one or more graduated gauges 110 and 112 that can be used to help adjust the bow for the desired string spacing. In this respect, these gauges can include string spacing increments marked thereon or merely include a number sequence so that the user can quickly adjust the system between one or more preferred adjustments. This measurement device can include a mere opening within the housing supporting the spring assembly wherein an engraved line can be seen though the opening to help the user make any adjustments. However, while only one type of gauge system is shown, any gauge system known in the art or which will be known in the art could be used without detracting from the invention of this application.

In addition, bow 10 can include a replaceable grip RG which can be utilized for a number of reasons. One such reason is to create further adjustability for distance D. In addition, the grip can be modified based on personal preferences or based on one's hand size. Therefore, the use of replaceable grip RG can be coupled with the adjustability of the firing systems wherein the bow of this application can be used by a wide range of archers and/or can be finely tuned or adjusted to a particular archer's desired configuration.

Figure 6:
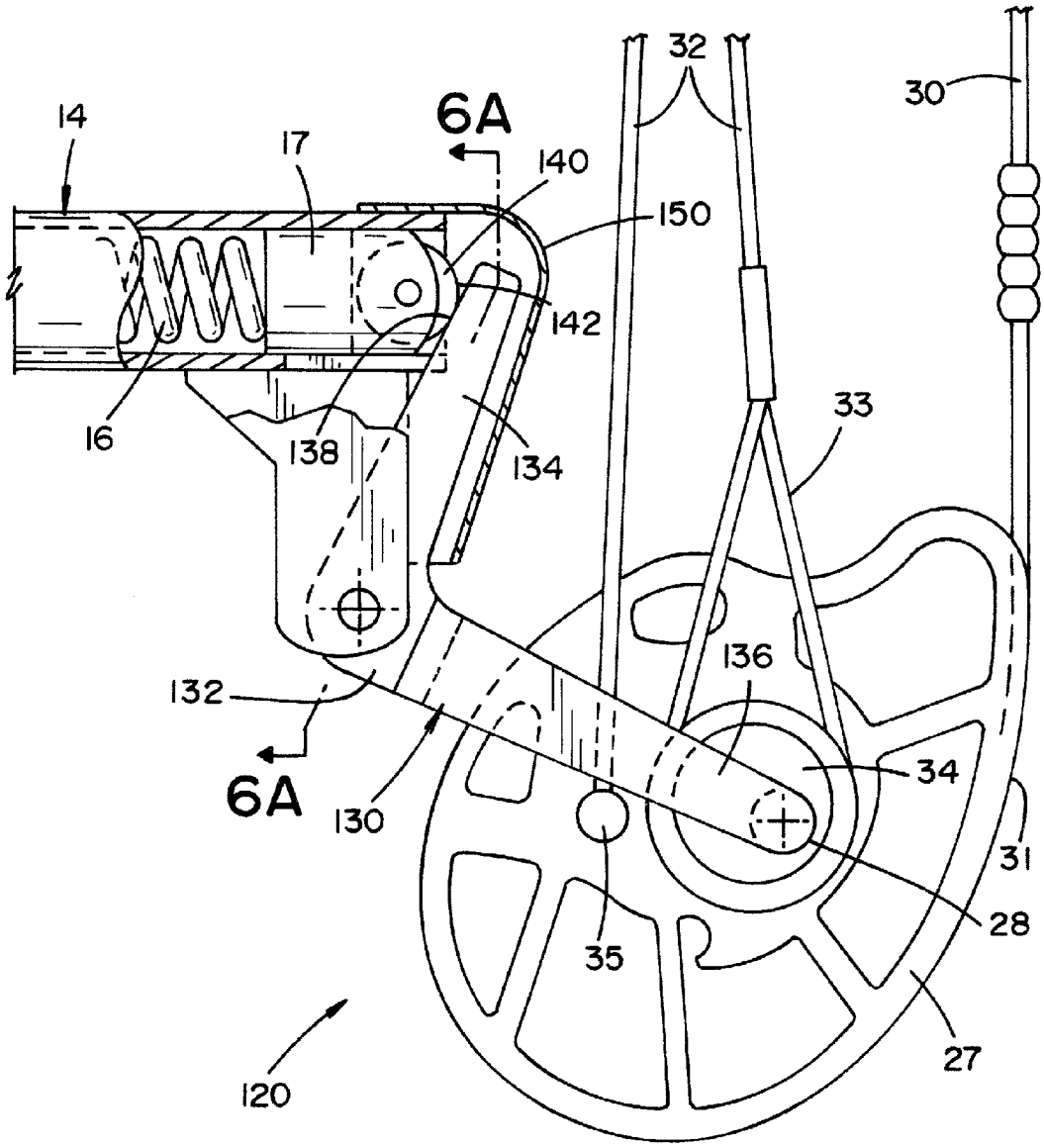
FIG. 6 is an enlarged partial cutaway elevational view of another firing system according to other aspects of the invention of this application.
Figure 6A:
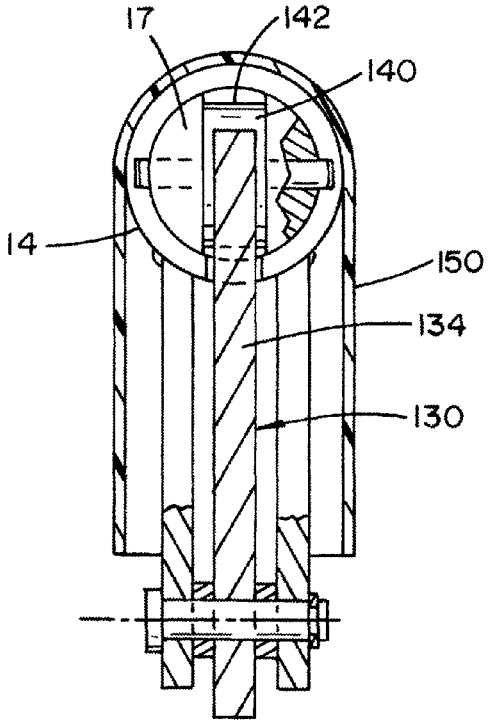
FIG. 6A is a sectional view taken along lines 6A-6A in FIG. 6.

With special reference to FIG. 6, shown is a firing system 120 that is similar in design with firing systems 100 and 102 but which includes a crank 130 that is also an L-shaped crank but which includes a central portion 132 that is spaced between legs 134 and 136. In the embodiments referenced above, while an L-shaped crank is shown, the pivot point of the crank is spaced from the L-shaped portion of the crank. Further, as is illustrated in this embodiment, either the crank or the spring assembly can include a roller 140 to further reduce the friction between the roller and leg 134, and also to reduce the sound produced by the bow when it is fired. In this respect, and as was discussed more above, prior art bows which utilize spring systems incorporate systems that are noisy in operation wherein these prior art bows cannot be effectively used for hunting. In that archery bows are primarily used for hunting, noisy spring systems prevent these prior spring-loaded bows from being effectively used in the field. However, applicant has found that the use of a compression spring in combination with the crank arrangements disclosed and claimed in this application, can virtually eliminate firing sounds to the point that the bow of this application is even quieter than the flexible limbs of a traditional compound bow that does not include springs. Part of this relates to the use of a bearing arrangement between the crank and the spring assembly to both reduce sound and to reduce friction. However, while it is preferred that the engagement between the crank and the spring cap include a roller bearing, the invention of this application is not to be limited thereto.

Yet even further, the bearing and/or spring leg can include a coating 142 to further reduce sound and to improve the feel of the bow when it is actuated. This coating can be a polymer based coating to reduce noise and increase the quality feel of the bow. In addition, dissimilar materials can also be used such as a polymer bearing that engages the metallic crank arm.

Figure 5:
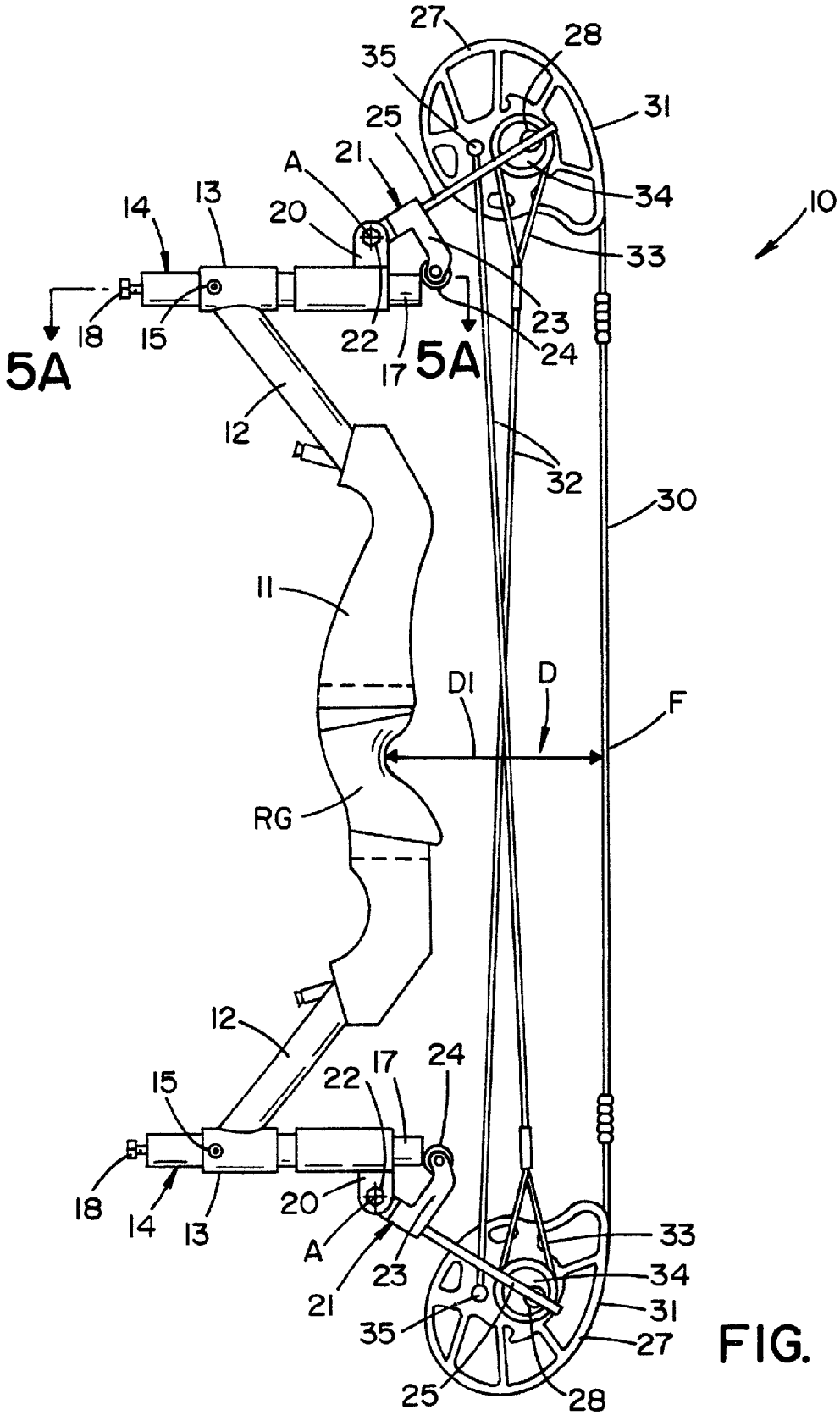
FIG. 5 is a side elevational view of a bow with a replaceable grip assembly.

In addition, firing system 120 can include a shield 150 that can be utilized to fully or partially cover the engagements between the spring leg 134 and roller 140 to increase safety and to reduce or prevent dirt buildup. In yet other embodiments, shield 150 and/or other structural components of the bow can include a rubber bumper(s) (not shown) that can engage one or more bow strings as the bow approaches the at rest condition (as is shown in FIGS. 1, 5 and 6). This configuration can further reduce the sounds of the bow by reducing the string vibration when the bow is shot. With respect to the shield, this shield could be a fully encapsulating flexible shield or a more rigid general shield as is shown.

Further, by including the roller bearing on the spring cap and/or the spring leg of the crank, the system can be more easily dissembled. While the bearing surface design creates extremely quiet and smooth actuation, this arrangement also allows for the easy adjustment and disassembly of the bow for modification and repair since the spring assembly is not attached to the lever. In this respect, while prior art bows may show use of a spring, these mechanisms have been found to be noisy and ineffective. Further, the complicated nature of these systems prevents them from being easily dissembled for repair or modification. In many designs, these systems cannot be dissembled for similar reasons as the traditional compound bow in that special equipment is needed to overcome the stored energy in the system to disconnect the spring from the remaining components. However, in accordance with the invention of this application, the spring assembly can be a self contained system that merely provides a pushing force, but which is not fixedly joined to the bow string directly or even indirectly. By including a spring assembly wherein the spring is essentially isolated, and not attached thereto, the mechanism can be dissembled without disassembly of the spring assembly. All that is needed is the adjustment of the spring assembly to reduce the stored energy of the spring and the remaining parts can then be easily removed.

As is shown in FIG. 6, spring arm 134 includes an engagement surface 138 to create this pushing engagement between the spring end cap and the lever arm wherein spring is not fixedly joined thereto. Essentially bearing 140 merely rolls along surface 138 as the lever is rotated.

In yet other embodiments of the invention of this application, surface 138 of arm 134 can be a cam surface wherein the engagement between this surface and the roller (or spring cap) can be utilized to further control the performance of the bow. This can be used to change the pull forces and even to further reduce the hold force in the full draw condition beyond what is provided by the roller cams connected by the bow strings. This cam like action can be used in combination with cam wheels on the bow string and could even be used to replace or minimize the need for the cam wheels. Either way, it can supplement the cam action of the wheels to improve bow performance. Even further, in that the bow of this application is easily relaxed to allow for disassembly, more than one crank design could be used for the bow to even further increase the adjustability of the bow.

With respect to disassembly, traditional bows and compound bows use the flexibility of the limbs to produce the needed stored energy to propel the archery arrow. As a result, these bow limbs must be mechanically compressed before the bow string is attached to produce the necessary string tension to propel the arrow at a high rate of speed. As can be appreciated, in order to produce fast arrow speeds, a large amount of force must be urged against these limbs to allow the bow to be either assembled or disassembled. This is done by way of a bow vice and this type of equipment is costly and not easily transported. As a result, the traditional archer does not own a bow vice and, therefore, cannot remove the bow string to make adjustments to his compound bow. Therefore, if the archer desires to change a cam or a roller in his bow, or to fix a broken bow string, he must take his bow to someone who specializes in bow repair. Even further, adjustments cannot be made in the field and repairs cannot be made in the field. This typically results in a hunter taking more than one bow on hunting trips just in case one fails.

Figure 7:
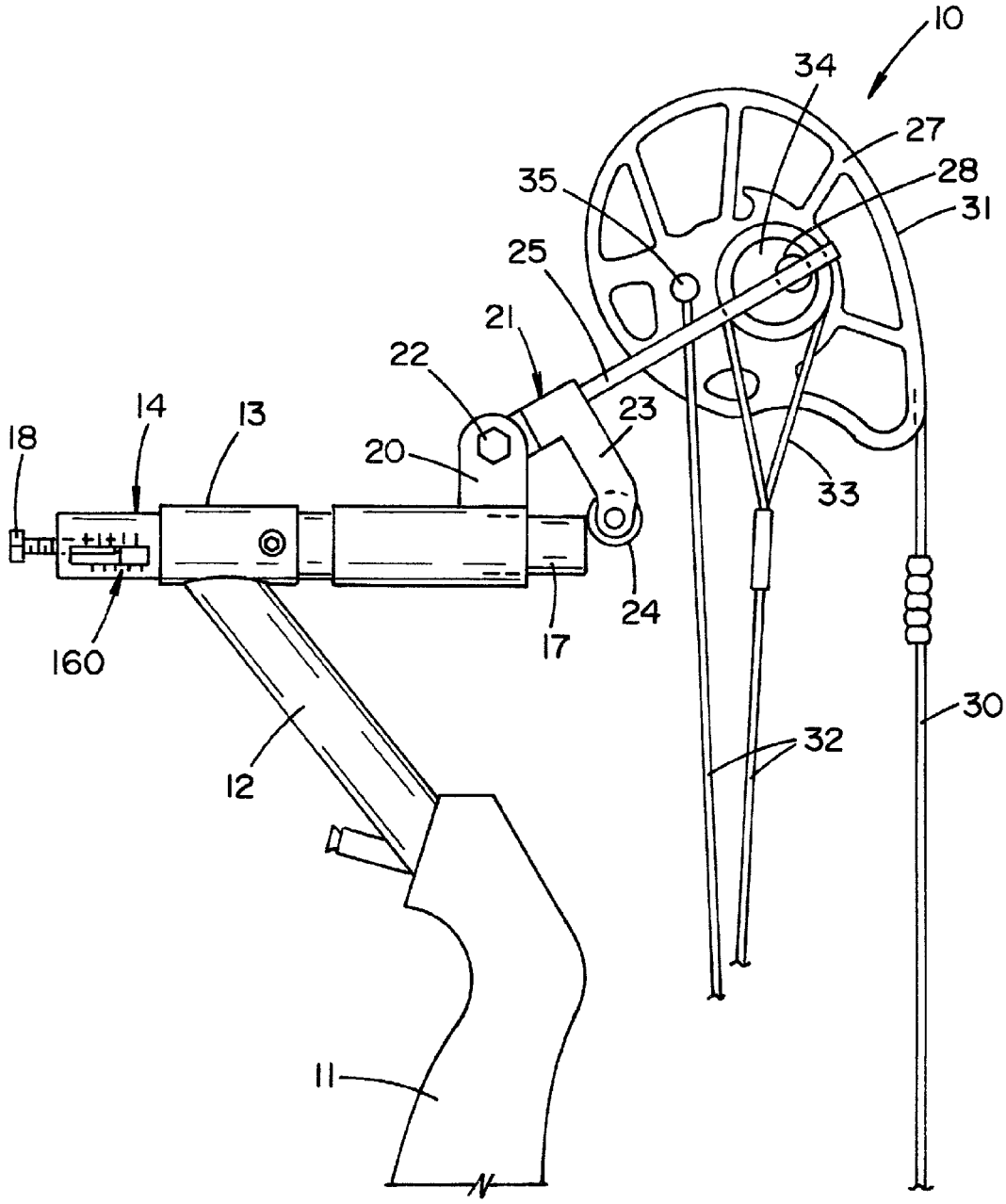
FIG. 7 is an enlarged partial cutaway elevational view of another firing system according to yet other aspects of the invention of this application.

According to one set of embodiments of the invention of this application, the spring 16 and spring assembly 14 is adjustable. This adjustability provides a number of benefits including the ability to reduce the spring force to a sufficient level to allow the removal of the bow string. Once the bow string is removed, the archer can make modifications to his bow and/or repair his bow including, but not limited to, replacing roller cams, idler wheels, and bow strings. Then once these modifications are made, the spring force can be adjusted upwardly to a desired level. With reference to FIG. 7, the adjustability of the internal spring force can be coupled with a spring gauge 160 that can be a graduated gauge to help measure or gauge the spring force of the particular spring assembly. As can be appreciated, it is best if the spring force of both spring assemblies is set to a similar level. Therefore, gauge 160 helps the archer both reset the bow after disassembly and modify the performance of the bow as desired. As was discussed more above, the bow of this application can be utilized for more than one archer in view of its high degree of adjustability. Further, the ability to adjust the spring force or stored energy within the spring assembly also helps with this adjustability. As also can be appreciated, the use of the bow by a younger archer may be best with a lower level of stored energy. Therefore, by including both the ability to adjust the physical size and configuration of the bow along with the ability to adjust the level of stored energy greatly increases the adaptability of the bow of this application to a wide range of archers. As can be appreciated in this art, this can drastically reduce inventory costs by the ability to make a single bow structure that can be used for many different archers with different degrees of experience and strength. Yet even further, this adjustment can be utilized to produce a desired arrow speed which can modify the effective range of the bow and can be utilized to slow arrow speeds to reduce the damage to targets when the archer is merely target shooting.

Figure 8:
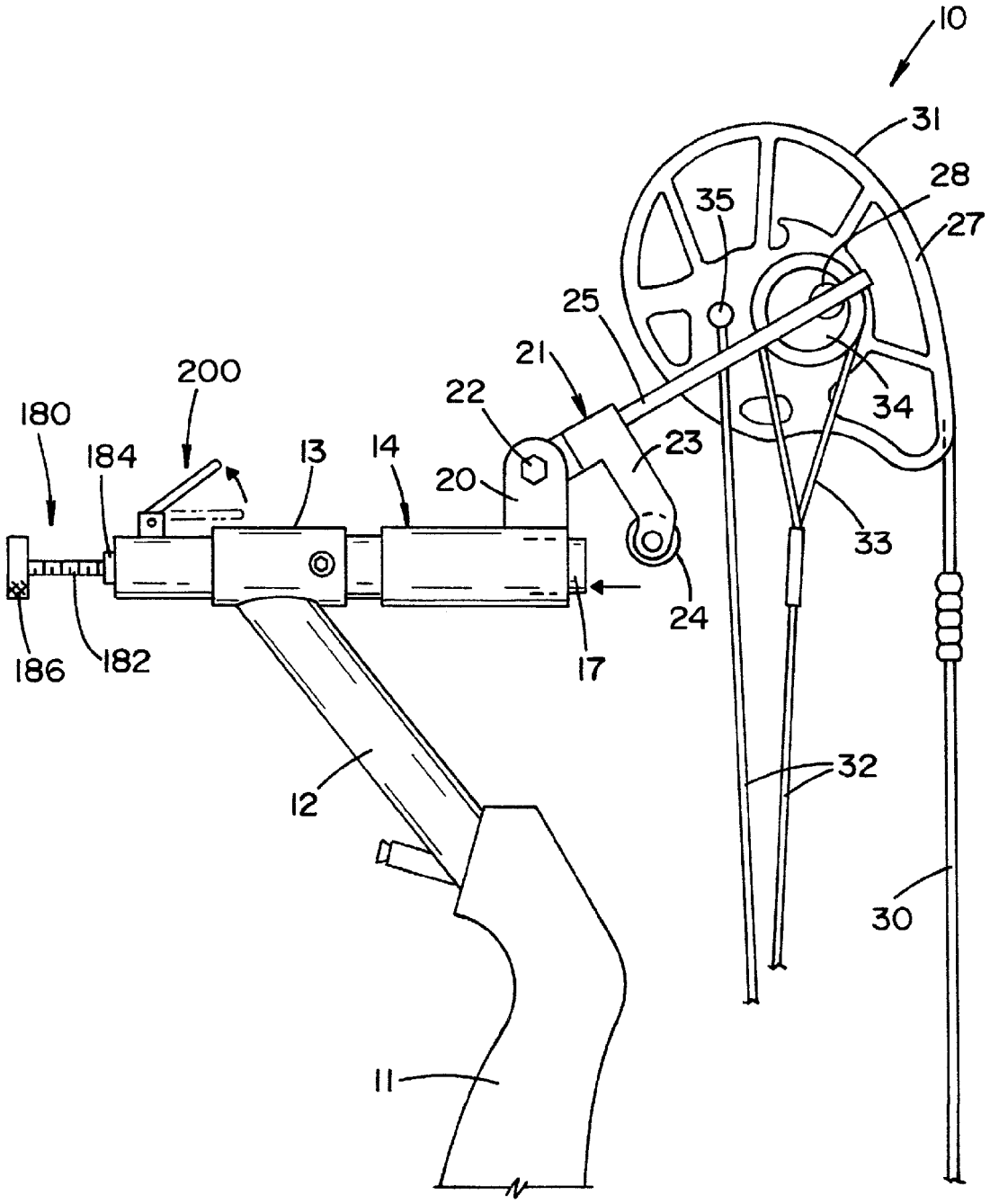
FIG. 8 is an enlarged partial cutaway elevational view of another firing system according to further aspects of the invention of this application.

As with the adjustability of the spring housing itself, gauge 160 can be a window, which can be covered, to measure the position of the forward end of the compression spring. As is shown in FIG. 7, this adjustment can be accomplished by a threaded bolt 18 which is adapted to be used by a tool wherein fastener 18 can have a tool receiving configuration including, but not limited, an Allen key, a hex head, a wing adjustment for finger tightening and the like. However, as is shown in FIG. 8, this adjustment can also utilize a hand crank assembly 180 having a threaded rod 182 that threadingly engages with a threaded nut 184 secured to spring assembly 14 such that the archer can rotate a knob 186 to make any necessary adjustments. As can be appreciated, the use of a larger knob can better facilitate the adjustment of the compression spring without the need for a tool.

Yet even further, gauge 160 can have multiple scales. In this respect, the ability of the bow of this application to be modified includes the ability to change the compression spring that is used in the spring assembly. For example, to further increase the range of adjustment different springs having different spring rates could be utilized. These springs can be, for example, a red spring for a hot or fast spring and a blue spring for a cold or slower spring. Therefore, the gauge could include one colored graduation for the hot or red spring and another colored graduation for the cold or slow spring. However, while only two springs are discussed, the amount of spring that could be used is limitless and could include different spring sets for different types of hunters including the general categories of age, experience and intended uses.

In yet other embodiments of the invention of this application, a toggle assembly 200 can be utilized for making adjustments to the springs of the firing systems. Further, the toggle can be used in combination with rotating adjustment knobs as were discussed above. In this respect, one of the advantages of the invention of this application includes the ability to remove some spring load or the entire spring load from the spring assembly to allow for the easy disassembly of the bow and/or modification of the bow. Toggle 200 can be utilized to actuate the firing system between a disassembled or non-shooting condition as is shown in FIG. 8, and an assembled or shooting condition as is shown in FIG. 2 wherein roller 24 is engaging end cap 17 or bearing 140 is engaging surface 138. However, the roller does not need to be fully removed from the end cap to allow for disassembly. Once the spring force is reduced to a certain level, the crank arm can be easily rotated a sufficient amount to remove the bow string. Again, once the bow string is removed, the cams and/or idler wheels can be replaced, repaired or modified. Then, once the desired modification or repair is made, the toggle can be re-actuated to the shooting condition wherein the spring force is fully applied to the crank arm.

Figure 9:
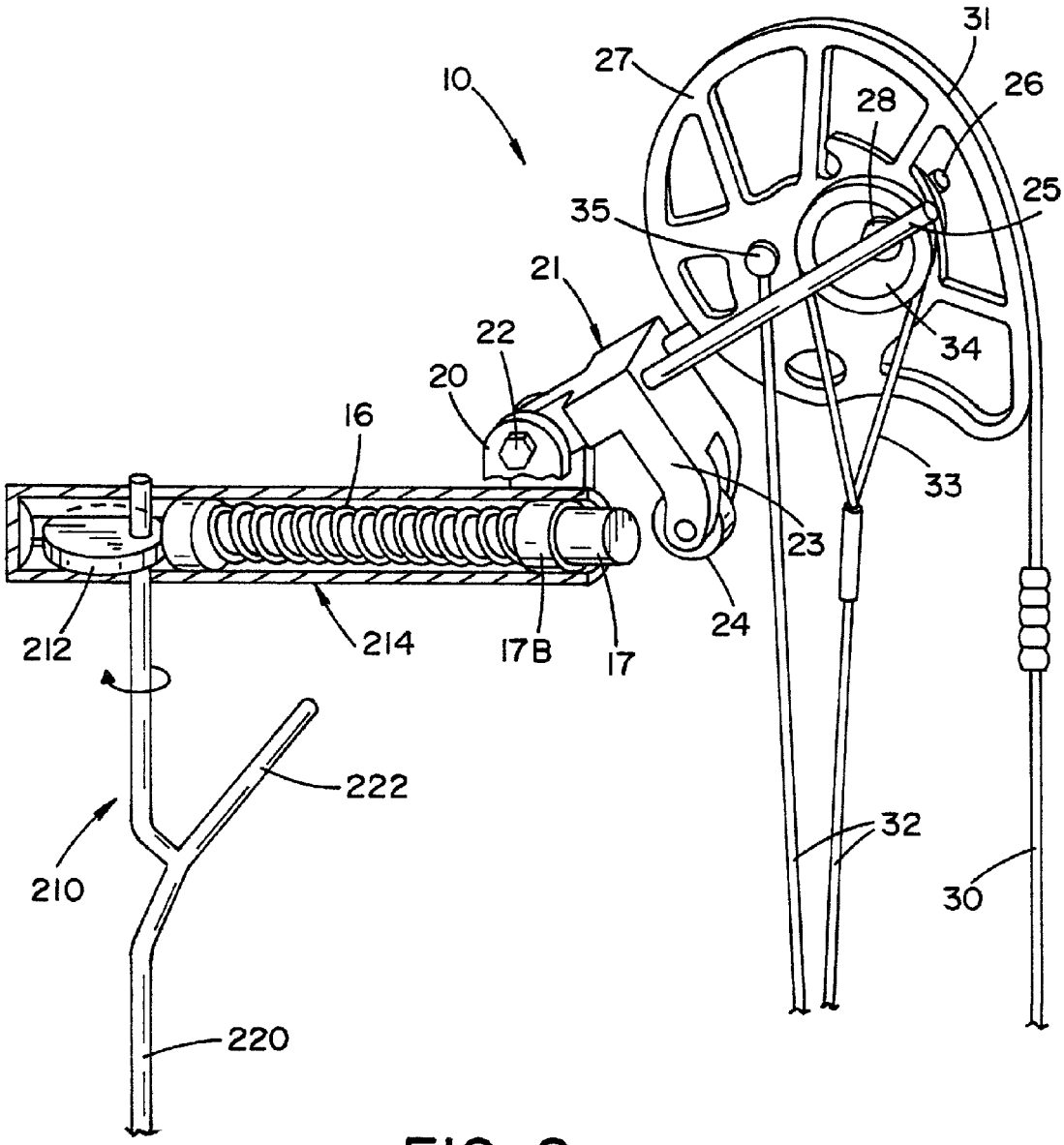
FIG. 9 is an enlarged perspective view of a cam lock system.

With reference to FIG. 9, the toggle or cam assembly to move the spring assemblies between a firing condition and a non-firing condition can include an assembly 210 having a cam 212 secured relative to spring assembly 214. Further, this system can include a linkage 220 wherein a single lever handle 222 can be used to actuate both spring assemblies simultaneously between the firing condition and the non-firing condition.

Figure 10:
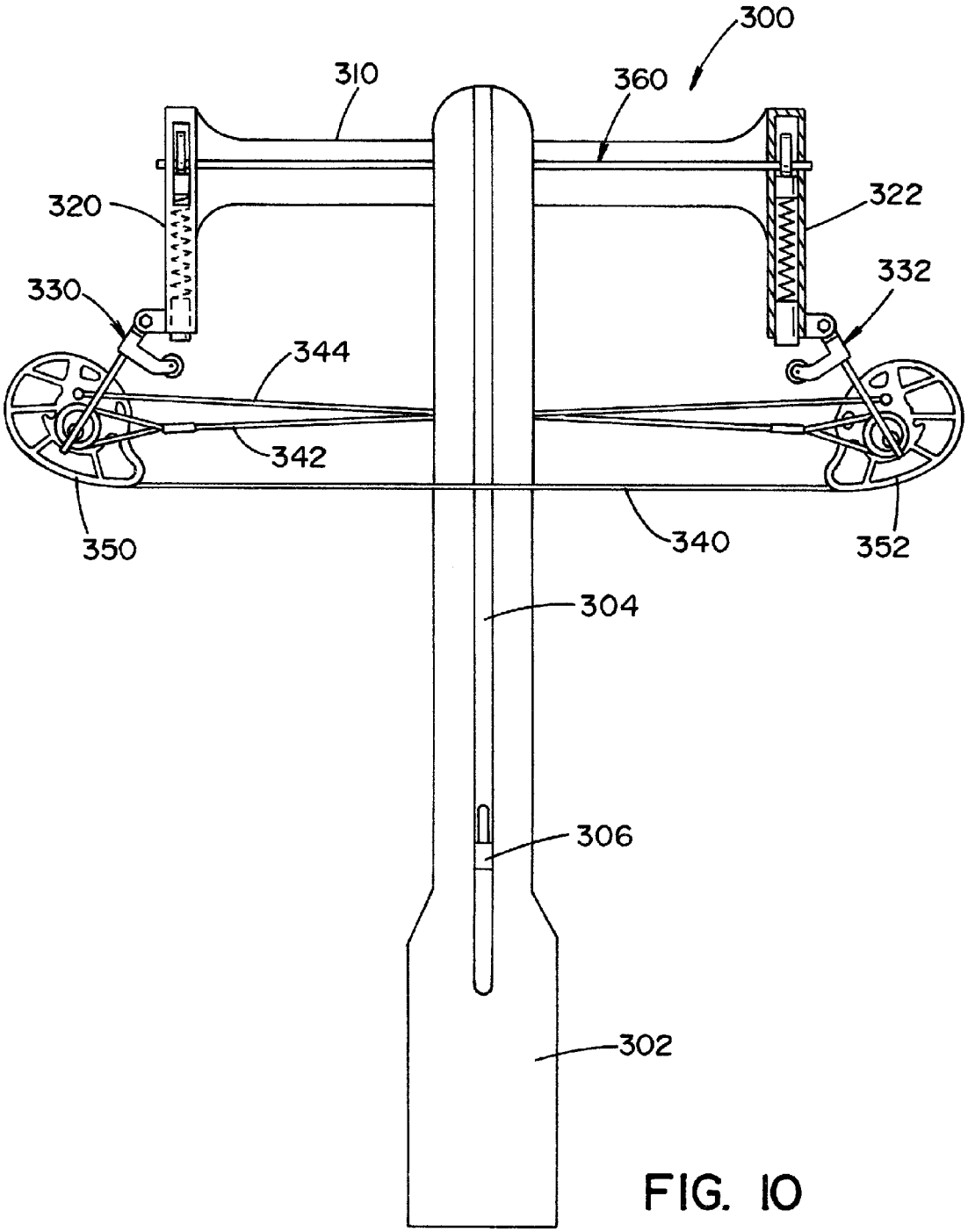
FIG. 10 is a top view of a crossbow incorporating the firing mechanism of this application.

With reference to FIG. 10, shown is a crossbow 300 having a crossbow stock 302, a bolt track 304, a trigger assembly 306 and a bow frame 310. This particular figure shows the bow in a non-firing condition wherein the springs of spring assemblies 320 and 322 are not engaging crank arms 330 and 332. As with the bows discussed above, crossbow 300 includes a bow string 340 and timing cables 342 and 344. In the interest of brevity, the details of the actuation of crossbow 300 will not be discussed in detail at this point in that any embodiment of this application can be utilized in connection with a crossbow. In general, however, crossbow 300 includes a first cam wheel 350 and a second cam wheel 352; however, the invention of this application in this embodiment (or any embodiment in this application) is not to be limited to a system having two cam wheels wherein idler wheels can be used with the invention of this application. Crossbow 300 further includes a toggle assembly 360 that, as was discussed above, can be utilized to actuate crossbow 300 between a shooting condition and a non-shooting condition.

Figure 5A:
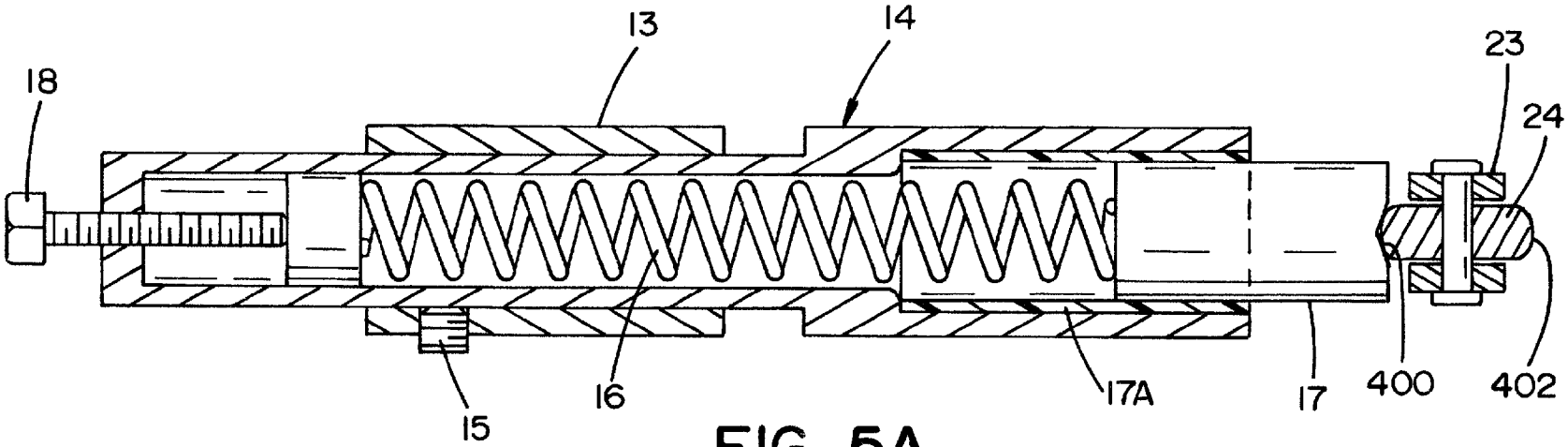
FIG. 5A is a sectional view taken along lines 5A-5A in FIG. 5.

In yet another set of embodiments, any of the rollers and/or corresponding members (caps and arms) can include guiding configurations. As is best shown in FIG. 5A as an example, cap 17 can include a V-Groove 400 and roller 24 can include an outer profile 402 that is shaped to be guided in V-Groove 400. While a V shaped groove is shown, any mating configuration could be used without detracting from the invention of this application. This configuration can prevent rotation of the cap and can improve the engagement between these components. Further, it can help keep the roller parallel with the string and/or in any desired alignment.

In even yet other embodiments, the bow of this application could be sold as a kit wherein the end user could fully assembly their bow based on their own special preferences. This can include multiple sets of any component discussed above including the ability to use the bow for multiple size users or different uses. Even further, the components could be sold individually wherein the archer could select their desired components and then assemble them. As can be appreciated, the potential combinations are limitless where retailers could greatly reduce inventory by only needing to stock a large volume of key parts instead of several fully customized and unique bows.

Again, this application is not to be limited to the use of a twin cam design; any wheel design can be utilized including, but not limited to, the shown twin cam design, single cam designs, hybrid cams, binary cams and/or idler wheels. All of these cam layouts and those discovered in the future are contemplated. Similarly, while the firing systems are shown attached to limbs or extensions, this is not required wherein the firing systems can be joined directly to the riser and/or bow frame. Further, even though the frame and/or rims are generally rigid, these can include some flexibility wherein the rigid frame structures are not to be interpreted to have no flexibility.

Figure 11:
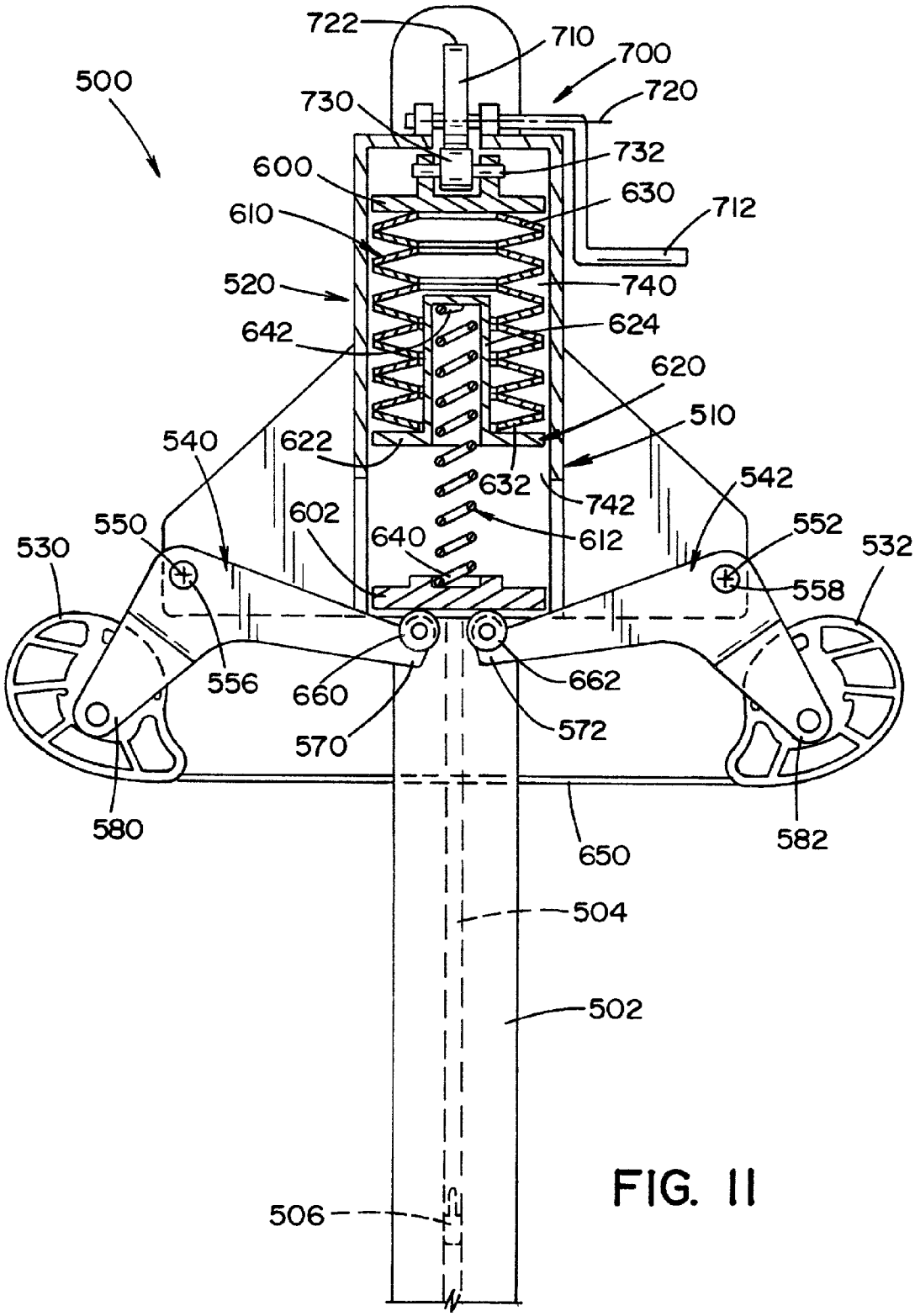
FIG. 11 is an enlarged partially sections bottom view of yet another embodiment of the invention of this application shown in an un-cocked condition and an unloaded condition; and, FIG. 12 is an enlarged partially sections bottom view of the embodiment shown in FIG. 11 shown in a cocked condition and a preloaded condition.
Figure 12:
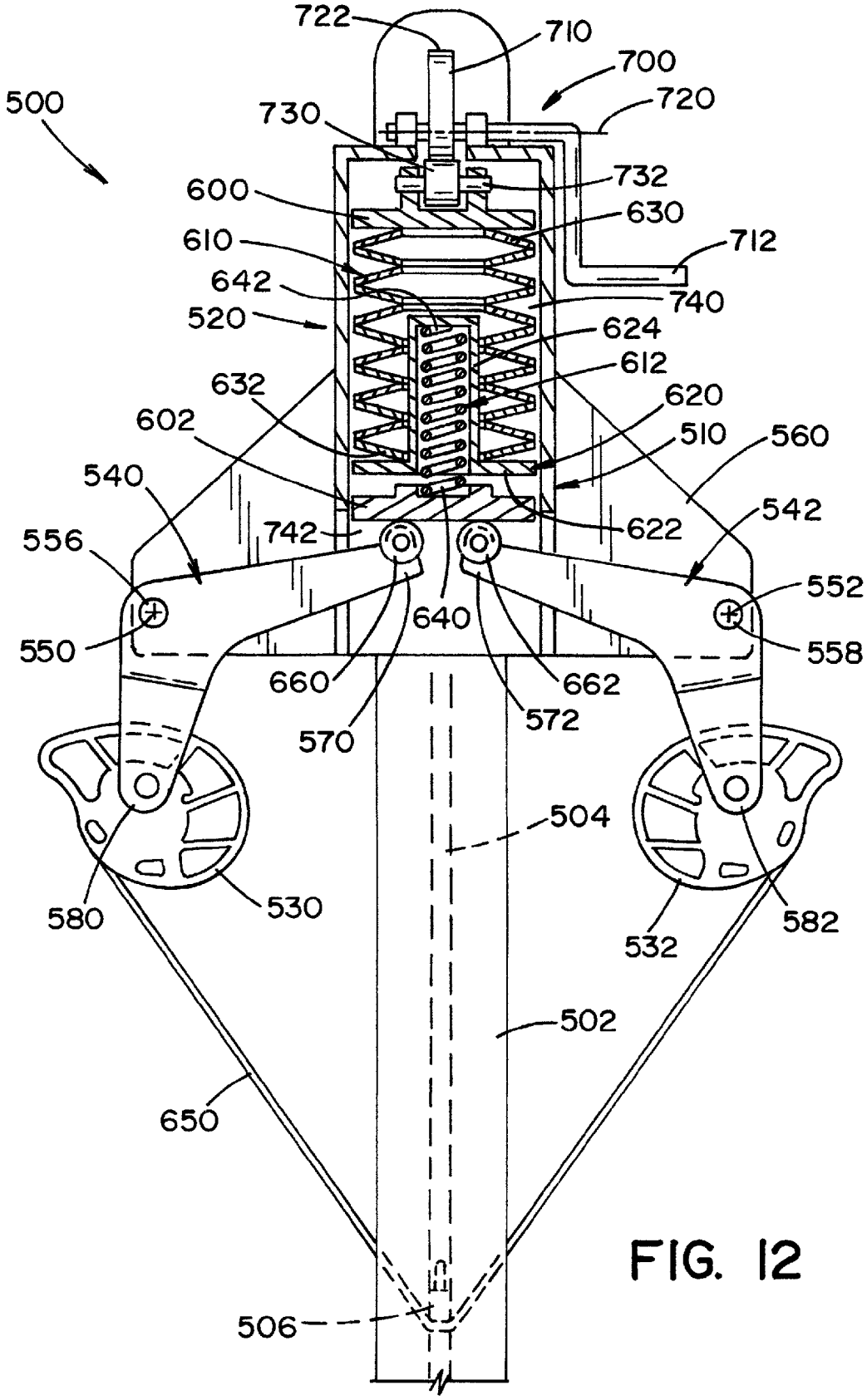
Figure 13:
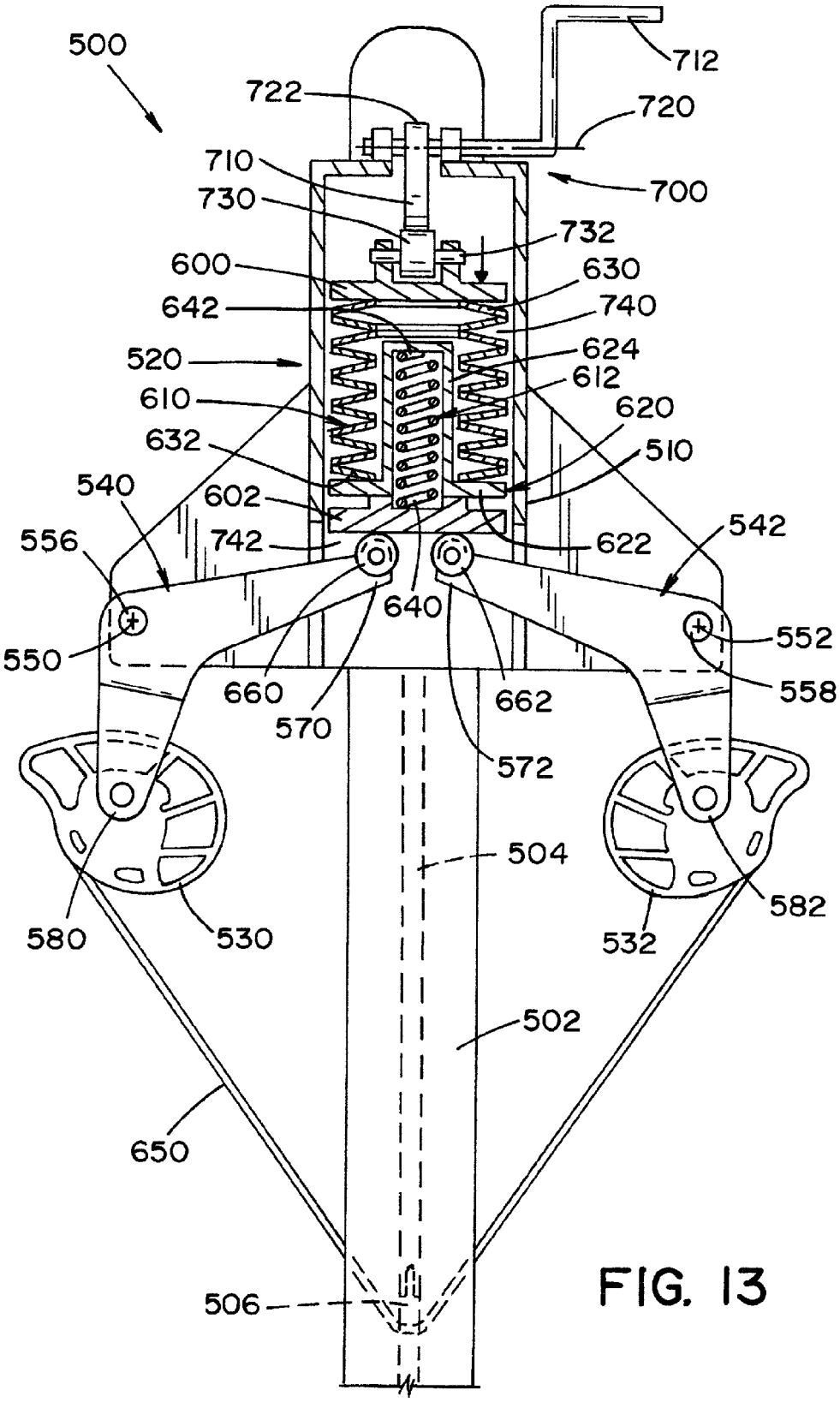
FIG. 13 is a partially sections bottom view of the embodiment shown in FIG. 11 shown in a cocked condition and a loaded condition.

With reference to FIGS. 11-13, shown is yet another set of embodiments that includes one of these hybrid designs. In this respect, shown are bottom views of a crossbow 500 that includes both a central spring configuration and a hybrid spring arrangement that has been found to work particularly well with a crossbow even though these sets of embodiments are not intended to be limited to crossbows. More particularly, crossbow 500 includes a crossbow stock 502, a bolt track 504, a trigger assembly 506 and a bow frame 510. The general configurations of a crossbow are shown in FIG. 10 and are generally known in the art wherein they will not be discussed in reference to this set of embodiments in the interest of brevity. FIG. 11 shows the bow in a non-firing or un-cocked condition wherein a spring assembly 520 is shown in a relaxed or un-cocked condition. FIG. 12 shows spring assembly 520 in a cocked and preloaded condition. FIG. 13 shows spring assembly 520 in a cocked and fully loaded condition wherein a shooting load is stored in the spring assembly. All of these figures will be disclosed more below. Further, as with all embodiments of this application, while the primary features of these embodiments will be discussed more below, other features of this application can be incorporated into these embodiments. These other features include, but are not limited to, a load adjustment feature to adjust the preload and/or full load levels of these embodiments. These can include, but are not limited to, variable adjustment and/or interchangeable spring assemblies.

In this set of embodiments, spring assembly 520 is a single and central spring assembly that provides the spring force or shooting force to both a first wheel 530 and a second wheel 532. As with all embodiments of this application, one or both of wheels 530 and 532 can be cam wheels as discussed above in greater detail and as is known in the art. While bow 500 includes a single spring assembly, the bow includes two crank arms 540 and 542 that pivot about crank axes 550 and 552, respectively. Crank axes 550 and 552 can be formed by shafts 556 and 558, respectively, which are fixed relative to a lower stock frame 560. By utilizing a lower stock frame, the spring assembly and cranks can be spaced below the shooting surface of the crossbow thereby preventing interference with the shooting of an arrow or bolt (not shown).

Crank arms 540 and 542 can be L-shaped and have spring ends 570 and 572, respectively and roller ends 580 and 582, respectively. As such, rollers 530 and 531 are joined to roller ends 580 and 582, respectively. Spring ends 570 and 572 are in engagement with spring assembly 520, which will be discussed more below.

More particularly, spring assembly 520 includes opposing spring assembly end plates 600 and 602 that include one or more springs between the end plates that at least in part create the shooting force to propel the arrow or bolt. In this particular embodiment, the one or more springs includes a first spring 610 and a second spring 612. While either spring can be any spring known in the spring art, in a preferred embodiment, spring 610 is a bellows spring arrangement and spring 612 is a coiled compression spring. Bellows spring arrangement 610 can a series of carbon composite bellows springs like those produced by MW Industries, Inc. of Indiana that are disclosed in International applications publication Nos. WO 2013/062644 and WO 2013/062555, which are both incorporated by reference into the specification of application as background material for bellows springs. Also incorporated by reference is the attached article Titled *Hyperco Carbon-Composite "Bellow Spring" "The Game Chancier"*. Further, spring assembly 520 includes a spring arrangement that ultimately forms two spring rates thereby allowing for both a pre-load to allow the crossbow to be cocked and a firing load. In greater detail, spring assembly includes a spring separation collar or plate 620 that includes a flange portion 622 and a spring pocket 624 shaped to receive a portion of coil spring 612. As a result, the spring force of coil spring 612 can be utilized to maintain the operational positioning of the bellows of bellow spring 610. As a result, spring 610 extends between an outside end 630 and an inside end 632 wherein outside end 630 engages spring plate 600 and inside end engages collar 622. Similarly spring 612 extends between an outside end 640 and an inside end 642 wherein outside end 640 engages spring plate 602 and inside end engages collar pocket 624. FIG. 11 shows spring arrangement 520 is this un-cocked condition wherein spring 612 creates a low spring force to hold the spring assembly in an operational condition that is preferred, but not required.

As with the bows discussed above, crossbow 500 includes a bow string 650 and can include timing cables (not shown in this set of figures, but are shown in prior figure and are known in the art). Again, in the interest of brevity, the general details of the actuation of crossbow 500 will not be discussed in detail at this point in that any embodiment of this application can be utilized in connection with a crossbow. However, for the particular embodiment shown, crossbow 500 includes a special single spring arrangement that allows both crank arms to engage the same spring arrangement. More particularly, as string 650 is pulled rearwardly to cock the crossbow, both crank arms 540 and 542 pivot about crank axes 550 and 552, respectively, and begin to compress the spring assembly. In the views shown, crank arm 540 will rotate counter clockwise and crank arm 542 will rotate clockwise. In order to reduce the friction between crank arms 540 and 542 and plate 602, the assembly can further include one or more rollers or bearings 660 and 662 that can be fixed relative to either the crank arms or the plate.

With special reference to FIGS. 11 and 12, the cross bow in FIG. 11 is shown in an un-cocked condition with bow string 650 spaced from the trigger assembly. Initial movement of the bow string toward trigger assembly 506 will primarily compress only coil spring 612 and end plate 602 will move toward spring plate 620 while spring 610 will generally remain as is shown in FIG. 11. Further, the spacing between plate 620 and plate 600 will remain generally equal during the movement of the crossbow from the un-cocked condition shown in FIG. 11 to the cocked condition shown in FIG. 12 and the compression of spring 612. Spring 612 is a smaller or lighter spring with a lower spring rate than spring 610 that allows the user to more easily load string 650 into or onto trigger assembly 506. As the spring approaches trigger assembly 506, plate 602 approaches spring plate 620 as is shown in FIG. 12. As is shown in FIG. 12, crossbow 500 is in a partially cocked condition and the spring assembly is in a pre-load condition. As is shown in FIG. 12, while plate 602 approaches plate 620 as the bow is moved into the cocked condition, they may not engage one another in this position. This can be used to prevent undue spring force being application to the bow string thereby reducing the forced needed to "cock" the bow. Further, once in this position, the spring load produced by spring 612 will help maintain the spring in the cocked condition, but in this condition the crossbow has only a preload and not a shooting load stored in the spring assembly.

With reference to FIGS. 12 and 13, crossbow 500 can then be toggled to introduce the shooting load. In this respect, bow 500 further includes a shooting load assembly 700 that is configured to apply a shooting load to the spring assembly. In greater detail, assembly 700 includes a cam 710 and a cam actuation handle 712 that can be fixed relative to stock 502. However, it must be appreciated that while one particular shooting load assembly is shown, a wide range of load assemblies, cams and/or handles could be utilized without detracting from the invention of this application. Cam 710 is configured to rotate about a cam axis 720 and includes an outward facing cam surface 722 that is eccentric wherein rotation of cam 710 about axis 720 moves surface 722 away from axis 720. Cam 710 is positioned such that it is configured to engage end plate 600 and urge plate 600 inwardly as cam 710 is actuated from the position shown in FIG. 12 to the position shown in FIG. 13. In order to reduce friction and the load needed to actuate load assembly 700, the assembly can include a bearing or roller 730. In the embodiment shown, roller 730 is fixed relative to plate 600 by a roller pin 732.

As lever 712 is rotated forwardly in the assembly configuration shown, assembly 700 is actuated to compress spring 610 and produce the shooting load. As can be appreciated, this can initially complete the compression of spring 612 and engage plate 602 against plate 620 before the primary compression of spring 610 begins. In addition, even though spring 612 has a lower spring rate than spring 610, opening 624 in spring separation collar 620 that allows spring 612 to extend past collar 620 will prevent spring 612 from going solid thereby reducing fatigue in spring 612. Further, as can be seen in these figures, even though spring 610 is compressed by the actuation of assembly 700, the crank arms do not move. Thus, the user of bow 500 only needs to overcome the spring force of spring 612 to both cock the crossbow and to move the bow into a firing condition or position. Then, actuation of assembly 700 only produces the energy needed to fire the arrow. However, as can be appreciated, if there is a gap between plates 602 and 620, actuation of assembly 700 may produce some minor movement of the crank arms. Yet further, while the embodiments shown have spring 610 forward of spring 612, this is not required and these components could be reversed.

Both springs 610 and 612 can be positioned in an internal passage 740 that have a rearward opening 742 that allows for the engagement between plate 602 and arms 540 and 542. This can be utilized to prevent dirt and debris from entering and interfering with the spring assembly. Further, this can be utilized to reduced sound.

It has been found that this firing assembly both greatly reduces the difficulty in cocking a crossbow in that cocking is separate from the loading of the crossbow with the firing load and reduces the overall weight of the cross bow.

In yet another set of embodiments, assembly 700 can utilize a threaded actuation system that replace the cam toggle lock describe above. Further, other systems could be utilized to actuate the spring or springs into the firing position without detracting from the invention of this application.

Similarly, the design of the yoke or the crank in general can come in many forms without detracting form the invention of this application. This can include, but is not limited to, the bow string wheels being joined to the side of the crank and not centered within a yoke.

Further while a compression spring has been found to work well for the invention of this application, it is not to be limited to a single coiled compression spring wherein other springs that allow for the spring loaded rotation of the crank could be utilized which can include, but is not limited to an air springs (which could further reduce sound), multiple coil springs per assembly and/or variable rate springs. Yet further, other spring technologies could be utilized including, but not limited to spring washers, Belleville springs, bellows springs, and these springs can be manufactured in a wide range of materials. In one particular set of embodiments described above, the spring arrangements can utilize carbon-composite bellows springs as are sold by MW. It has been found that these carbon bellows springs respond quicker and also retain their rate better than conventional springs. Further, in a crossbow application, the spring load can be much greater than a long blow or compound bow since the drawn string does not need to be held by the hunter wherein carbon bellows springs have been found to greatly increase the performance of the bow. This ability to increase shooting force is further increased by including the two stage spring force arrangement discussed above wherein the shooting force is not applied until after the crossbow is cocked. Yet further, different spring technologies can be utilized with one another to create a desired spring actuation. Also discussed above, it has been found that a traditional coiled compression spring can work in combination with a composite bellows to create a pre-load and a shooting load spring force. Other similar combinations, including coil springs of different diameters can be utilized together to create a pre-load and a shooting load spring force without detracting from the invention of this application. Again, sets of any of these springs could also be utilized to produce different arrow speeds and these sets could be marked (such as color marked) based on their stored energy.

As for the bellows springs, the overall spring rate can be modified by one or more of the adjustment features discussed above. But, in addition, bellows springs provide the ability to adjust spring rate, firing forces, draw weight, etc., by adding, subtracting and/or rearranging the individual bellow washers of the bellows spring. The rearranging can include changing some of the washers to be in a parallel arrangement with adjacent washers. This feature can significantly increase the adjustability of the bow and; thus, can further increase the ability to customize the bow to work with different hunters, different hunting environments, different ranges and different arrow speeds. As a result, the bows according to the invention of this application are extremely customizable and can even be customized by the end user, which is unheard of in this industry.

In addition, any materials known in the archer field and/or mechanical fields could be used for the components of this application. This includes use of polymers, composites, metal, aluminum, metal allows, rubbers and the like. Further, any finishes and material treatments could be utilized including paints, oxide coatings, powder coatings, wrapped coatings, camouflage prints, heat treatments and the like. Coatings can also be included in the internal portions of the components and assemblies of this application. This can include friction reducing coatings used between any components and can include an internal coating in the spring tubes. This internal coating can be utilized to reduce friction and/or reduce noise.

It should be clear at this time that a compound spring loaded archery bow has been provided which advantageously can be adjusted for individual archers both in terms of the positioning of the bow string relative to the riser and limbs as well as adjusting the force required to pull the bow string. However, the present invention is not to be construed as limited to the forms shown which are to be considered illustrative rather than restrictive.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

It is claimed:

1. A crossbow for shooting an arrow, the crossbow comprising a bow frame extending between a front end and a rear end, the bow frame including a trigger assembly configured to selectively interengage with a bow string to control the firing of the crossbow, the crossbow further including a firing system joined relative to the bow frame, the firing system having a single spring assembly having at least one spring that is actuateable between an unloaded condition and a fully loaded condition wherein the spring assembly has a designated amount of stored energy to propel an associated arrow when in the loaded condition, the spring assembly having an exposed spring plate that moves with the actuation of the at least one spring, the firing system further including a first crank rotatably attached relative to the bow frame about a first crank axis and having a first spring leg and a first string leg with a first pivot region joining the first spring and string legs, the first spring leg being shaped to engage the exposed spring plate, the string leg having a first mount to rotatably support a first rotatable bow string support about a first support axis wherein the first support includes a first outwardly facing guide groove for a bow string that is guided therein about the first support axis; the firing system further including a second crank rotatably attached relative to the bow frame about a second crank axis that is spaced from the first crank axis, the second crank having a second spring leg and a second string leg with a second pivot region joining the second spring and string legs, the second spring leg being shaped to engage the exposed spring plate, the string leg having a second mount to rotatably support a second rotatable bow string support about a second support axis wherein the second support includes a second outwardly facing guide groove for the bow string that is guided therein about the second support axis; the bow string being joined between the first and second first rotatable bow string supports wherein when the bow string is pulled from an at rest condition to a full drawn condition the first and second rotatable bow string supports rotate and are urged toward one another thereby rotating the first and second cranks about the first and second crank axes thereby compressing the at least one spring, the at least one spring springs providing an amount of stored energy to propel an associated arrow when the bow string is released by the trigger assembly.

2. The crossbow of claim 1 wherein the firing system includes an internal spring cavity and the at least one spring extends along a spring axis between the unloaded condition and fully loaded condition within the spring cavity, the spring cavity having a spring cavity opening for the exposed spring plate.

3. The crossbow of claim 2 further includes a first and a second roller bearing, the first roller bearing being positioned between the first spring leg and the exposed spring plate and the second roller bearing being position between the second spring leg and the exposed spring plate.

4. The crossbow of claim 2 wherein the associated arrow is positioned and fired along a firing axis, the spring axis being generally parallel to the firing axis of the associated arrow and the spring cavity opening and the exposed spring plate are rearwardly facing.

5. The crossbow of claim 4 wherein the first and second crank axes are perpendicular to the firing axis.

6. The crossbow of claim 1 wherein the exposed spring plate is a first spring end plate and the single spring assembly further including a second spring end plate opposite of the first spring end plate, the at least one spring extending between the first and second spring end plates, the second spring end plate being selectively movable relative to the bow frame to change the spring force produced by the firing system.

7. The crossbow of claim 6 further including a load assembly configured to engage the second spring end plate wherein the load assembly is configured to selectively move the second spring between an outward position and an inward position wherein the movement to the inward position compresses the at least one spring.

8. The crossbow of claim 7 wherein the at least one spring includes a first spring and a second spring, the first spring having a first spring rate and the second spring having a second spring rate, the second spring rate being greater than the first spring rate, the first spring producing a preload force when the crossbow is cocked, the second spring producing a shooting load when the load assembly is in the inward position.

9. The crossbow of claim 8 wherein the second spring has a central spring passage coaxial with the spring axis, the single spring assembly further including a spring separation collar between the first and second springs, the spring separation collar including a support flange configured to support one end of the second spring, the other end of the second spring being supported by the second spring end plate, the spring separation collar further includes an elongated spring pocket extending into the central spring passage, the spring pocket shaped to receive a portion of the first spring and the first spring extending between the first spring end plate and the elongate spring pocket, the first spring end plate moving toward the spring separation collar as the crossbow is cocked, the spring separation collar engaging the first spring plate when the load assembly is in the inward position wherein the first spring generally produces the preload force the second spring generally produces the shooting load.

10. The crossbow of claim 9 wherein the second spring is extends forwardly of the first spring.

11. The crossbow of claim 9 wherein the first and second springs are compression springs.

12. The crossbow of claim 11 wherein the first spring is a coil spring and the second spring is a bellows spring.

13. The crossbow of claim 12 wherein the second spring is a carbon composite bellows spring.

14. The crossbow of claim 11 wherein the first spring is a coil spring and the second spring is a coil spring.

15. The crossbow of claim 1 wherein the single spring assembly is forward of the first and second crank arms.

16. The crossbow of claim 1 wherein the single spring assembly includes a first spring end plate and a second spring end plate opposite of the first spring end plate, the at least one spring extending between the first and second spring end plates and including a first spring and a second spring wherein the first spring engages the first spring end plate and the second spring engages the second end plate, the single spring assembly further including a spring separation collar separating the first and second springs, the spring separation collar including a support flange configured to support one end of the second spring such that the second spring extends between the support flange and the second spring end plate, the spring separation collar further including an elongated spring pocket extending into a central spring passage of the second spring, the spring pocket shaped to receive a portion of the first spring and the first spring extending between the first spring end plate and the elongate spring pocket.

17. The crossbow of claim 16 wherein the exposed spring plate is a part of the first spring end plate.

18. The crossbow of claim 16 wherein the exposed spring plate is a part of the second spring end plate.

19. The crossbow of claim 16 wherein the second spring end plate is selectively movable relative to the bow frame to change the spring force produced by the firing system.

20. The crossbow of claim 19 further including a load assembly configured to engage the second spring end plate for the selective moveability of the second spring plate.

21. The crossbow of claim 16 wherein the first spring has a first spring rate and the second spring having a second spring rate, the second spring rate being greater than the first spring rate, the first spring producing a preload force when the crossbow is cocked, the second spring producing a shooting load when the load assembly is in the inward position.

22. The crossbow of claim 21 wherein the first spring end plate moves toward the spring separation collar as the crossbow is cocked, the spring separation collar engaging the first spring plate when the load assembly is in the inward position wherein the first spring generally produces the preload force the second spring generally produces the shooting load.

23. The crossbow of claim 22 wherein the second spring end plate moves toward the spring separation collar to produce the firing load and the first spring end plate engaging the spring separation collar, the elongated spring pocket preventing the first spring from going solid.

24. The crossbow of claim 1 wherein the single spring assembly includes a spring force adjuster, the spring force adjuster allowing the stored energy of the firing system to be selectively modified in a given range.

25. The crossbow of claim 1 wherein the exposed spring plate is a first spring end plate and the single spring assembly further including a second spring end plate opposite of the first spring end plate, the at least one spring extending between the first and second spring end plates, the second spring end plate being selectively movable relative to the bow frame to change the spring force produced by the firing system, the crossbow further including a load assembly configured to engage the second spring end plate wherein the load assembly is configured to selectively move the second spring between an outward position and an inward position wherein the movement to the inward position compresses the at least one spring, the load assembly including a cam and a cam handle joined to the cam to rotate the cam about a cam axis, the cam further including an outer cam surface configured to engage the second end plate wherein rotation of the cam by the cam handle selectively moves the second end plate along a spring axis.

* * * * *